US011339607B2

(12) United States Patent
Cheng

(10) Patent No.: US 11,339,607 B2
(45) Date of Patent: May 24, 2022

(54) CONTROLLER ASSEMBLY FOR WINDOW BLIND APPARATUS

(71) Applicant: Ching-Hsiang Cheng, Tainan (TW)

(72) Inventor: Ching-Hsiang Cheng, Tainan (TW)

( * ) Notice: Subject to any disclaimer, the term of this patent is extended or adjusted under 35 U.S.C. 154(b) by 0 days.

(21) Appl. No.: 16/932,041

(22) Filed: Jul. 17, 2020

(65) Prior Publication Data

US 2021/0017812 A1 Jan. 21, 2021

(30) Foreign Application Priority Data

Jul. 18, 2019 (TW) ..... 108125464

(51) Int. Cl.
*E06B 9/322* (2006.01)
*E06B 9/323* (2006.01)
*E06B 9/324* (2006.01)

(52) U.S. Cl.
CPC ..... *E06B 9/322* (2013.01); *E06B 9/323* (2013.01); *E06B 9/324* (2013.01); *E06B 2009/3225* (2013.01)

(58) Field of Classification Search
CPC ..... E06B 9/322; E06B 9/323; E06B 9/324; E06B 2009/3225; E06B 2009/2441; E06B 2009/2627; E06B 2009/6881; E06B 9/88; E06B 9/90
See application file for complete search history.

(56) References Cited

U.S. PATENT DOCUMENTS

| | | | | |
|---|---|---|---|---|
| 6,655,441 | B2 * | 12/2003 | Wen | E06B 9/322 160/168.1 P |
| 8,365,797 | B2 * | 2/2013 | Drew | E06B 9/262 160/84.05 |
| 8,720,523 | B2 * | 5/2014 | Nakamura | E06B 9/262 160/167 R |
| 8,752,607 | B2 * | 6/2014 | Anderson | E06B 9/262 160/171 |
| 9,739,089 | B2 * | 8/2017 | Smith | E06B 9/32 |
| 10,655,388 | B2 * | 5/2020 | Smith | E06B 9/42 |
| 10,753,148 | B2 * | 8/2020 | Jay | E06B 9/88 |
| 10,781,635 | B2 * | 9/2020 | Cheng | E06B 9/80 |
| 11,072,974 | B2 * | 7/2021 | Wong | E06B 9/90 |
| 2015/0376941 | A1 * | 12/2015 | Fujita | E06B 9/60 160/241 |
| 2019/0352963 | A1 * | 11/2019 | Jang | E06B 9/40 |
| 2019/0376340 | A1 * | 12/2019 | Smith | E06B 9/88 |

* cited by examiner

*Primary Examiner* — Johnnie A. Shablack
(74) *Attorney, Agent, or Firm* — Muncy, Geissler, Olds & Lowe, P.C.

(57) ABSTRACT

A controller assembly includes a housing, first and second tube units, and first and second runners. Each of the first and second runners slides on a respective one of the first and second tube units when the respective one of the first and second tube units is driven to rotate. In response to sliding of the first runner to bring the first runner into abutment with the second runner, the first runner is prevented from sliding over the second runner, whilst impeding rotation of the first tube unit. In response to sliding of the second runner to bring the second runner into abutment with the first runner, the second runner is prevented from sliding over the first runner, whilst impeding rotation of the second tube unit.

4 Claims, 22 Drawing Sheets

CONTROLLER ASSEMBLY FOR WINDOW BLIND APPARATUS

CROSS-REFERENCE TO RELATED APPLICATION

This application claims priority from Taiwanese invention patent application no. 108125464, filed on Jul. 18, 2019.

FIELD

The disclosure relates to a controller assembly for a window blind apparatus, more particularly to a controller assembly for controlling relative movement of two rails in a window blind apparatus.

BACKGROUND

A cellular shade is a window covering for blocking or filtering light entering a room through a window, and the cellular shade traps the air in cells thereof so as to serve as a thermal barrier between the window and the room.

Referring to FIGS. 1 to 3, a conventional window blind device is shown to include a headrail 11, a middlerail 161, a bottomrail 162, a first cellular shade 171, a second cellular shade 172, a first force output member 12, a first actuating cord 121, a first drive shaft 13, a second force output member 12', a second actuating cord 121', a second drive shaft 13', two spool units 14, two first lift cords 151, and two second lift cords 152. The first cellular shade 171 is connected between the headrail 11 and the middlerail 161. The second cellular shade 172 is connected between the middlerail 161 and the bottomrail 162. The first and second force output members 12, 12' are disposed in the headrail 11 and are spaced apart from each other in the left-right direction. The first and second drive shafts 13, 13' are respectively coupled to be driven by the first and second force output members 12, 12' to rotate. The first force output member 12 is actuated by the first actuating cord 121 to output a rotational force for driving rotation of the first drive shaft 13. The second force output member 12' is actuated by the second actuating cord 121' to output a rotational force for driving rotation of the second drive shaft 13'. The spool units 141 are disposed in the headrail 11 and are spaced apart from each other in the left-right direction. Each of the spool units 14 includes a first tubular spool 141 and a second tubular spool 142 which are respectively sleeved on and rotate with the first and second drive shafts 13, 13'. Each of the first lift cords 151 has two first cord ends, one of which is connected to the first tubular spool 141 of a respective one of the spool units 14, and the other one of which is connected to a respective one of left and right segments of the middlerail 161. Each of the second lift cords 152 has two second cord ends, one of which is connected to the second tubular spool 142 of a respective one of the spool units 14, and the other one of which is connected to a respective one of left and right segments of the bottomrail 162.

The conventional window blind device is transformable among a first shading position (FIGS. 1 to 3), a second shading position (FIGS. 4 and 5), a fully collapsed position (FIGS. 6 and 7), and a partially collapsed position (FIGS. 8 and 9).

In the first shading position, as shown in FIGS. 1 to 3, the first cellular shade 171 has a relatively large covering area, the first lift cords 151 are fully unwound from the first tubular spools 141 of the spool units 14, respectively, and the second lift cords 152 are fully unwound from the second tubular spools 142 of the spool units 14, respectively.

To transform the conventional window blind device from the first shading position to the second shading position, the first actuating cord 121 is actuated to drive rotation of the first drive shaft 13 to permit the first tubular spools 141 to rotate windingly. Meanwhile, the first lift cords 151 are respectively wound on the first tubular spools 141 to lift the middlerail 161. After the middlerail 161 is lifted to a first uppermost position, the conventional window blind device is transformed to the second shading position (FIGS. 4 and 5). In the second shading position, the second cellular shade 172 has a relatively large covering area.

To transform the conventional window blind device from the second shading position to the fully collapsed position, the second actuating cord 121' is actuated to drive rotation of the second drive shaft 13' to permit the second tubular spools 142 to rotate windingly. Meanwhile, the second lift cords 152 are respectively wound on the second tubular spools 142 to lift the bottomrail 162. After the bottomrail 162 is lifted to a second uppermost position, the conventional window blind device is transformed to the fully collapsed position (FIGS. 6 and 7). In the fully collapsed position, both the first and second cellular shades 171, 172 are collapsed.

To transform the conventional window blind device from the fully collapsed position to a partially collapsed position, the first actuating cord 121 is actuated to drive rotation of the first drive shaft 13 to permit the first tubular spools 141 to rotate unwindingly, while the second actuating cord 121' is actuated to drive rotation of the second drive shaft 13' to permit the second tubular spools 142 to rotate unwindingly. Meanwhile, a portion of each of the first lift cords 151 is unwound from a respective one of the first tubular spools 141 to move the middlerail 161 downwardly, and a portion of each of the second lift cords 152 is unwound from the second tubular spools 142 to move the bottomrail 162 downwardly, thereby transforming the conventional window blind device to the partially collapsed position.

However, when transforming the conventional window blind device, the bottomrail 162 may be moved upwardly over the middlerail 161, and the middlerail 161 may be moved downwardly over the bottomrail 162 due to an improper operation of the first actuating cord 121 or the second actuating cord 121'. This may cause loosening of the first or second lift cord(s) 151, 152 as shown in FIG. 9 or cause tangling of the first or second lift cord(s) 151, 152.

SUMMARY

Therefore, an object of the disclosure is to provide a controller assembly for controlling operation of a window blind apparatus, which is useful to overcome the drawback of the prior art.

According to the disclosure, a controller assembly includes a housing, a first tube unit, a second tube unit, a first runner, and a second runner. The first tube unit has a first outer threaded surface, and is rotatably retained in the housing. The first tube unit is coupled to be driven by a first drive shaft to rotate about a first axis which extends in a left-right direction. The second tube unit has a second outer threaded surface, and is rotatably retained in the housing. The second tube unit is spaced apart from the first tube unit in a front-rear direction, and is coupled to be driven by the second drive shaft to rotate about a second axis which extends in the left-right direction. The first runner has a first inner threaded bore which is configured to be in threaded engagement with the first outer threaded surface of the first tube unit. The first runner is retained to slide along the first axis when the first tube unit is driven to rotate about the first axis. The second runner has a second inner threaded bore which is configured to be in threaded engagement with the second outer threaded surface of the second tube unit. The second runner is retained to slide along the second axis when the second tube unit is driven to rotate about the second axis. The first and second runners are configured to be brought into abutment with each other in the left-right direction such that in response to leftward sliding of the first runner to bring the first runner into abutment with the second runner, the first runner is prevented from sliding leftward over the second runner, whilst impeding rotation of the first tube unit, and such that in response to rightward sliding of the second runner to bring the second runner into abutment with the first runner, the second runner is prevented from sliding rightward over the first runner, whilst impeding rotation of the second tube unit.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
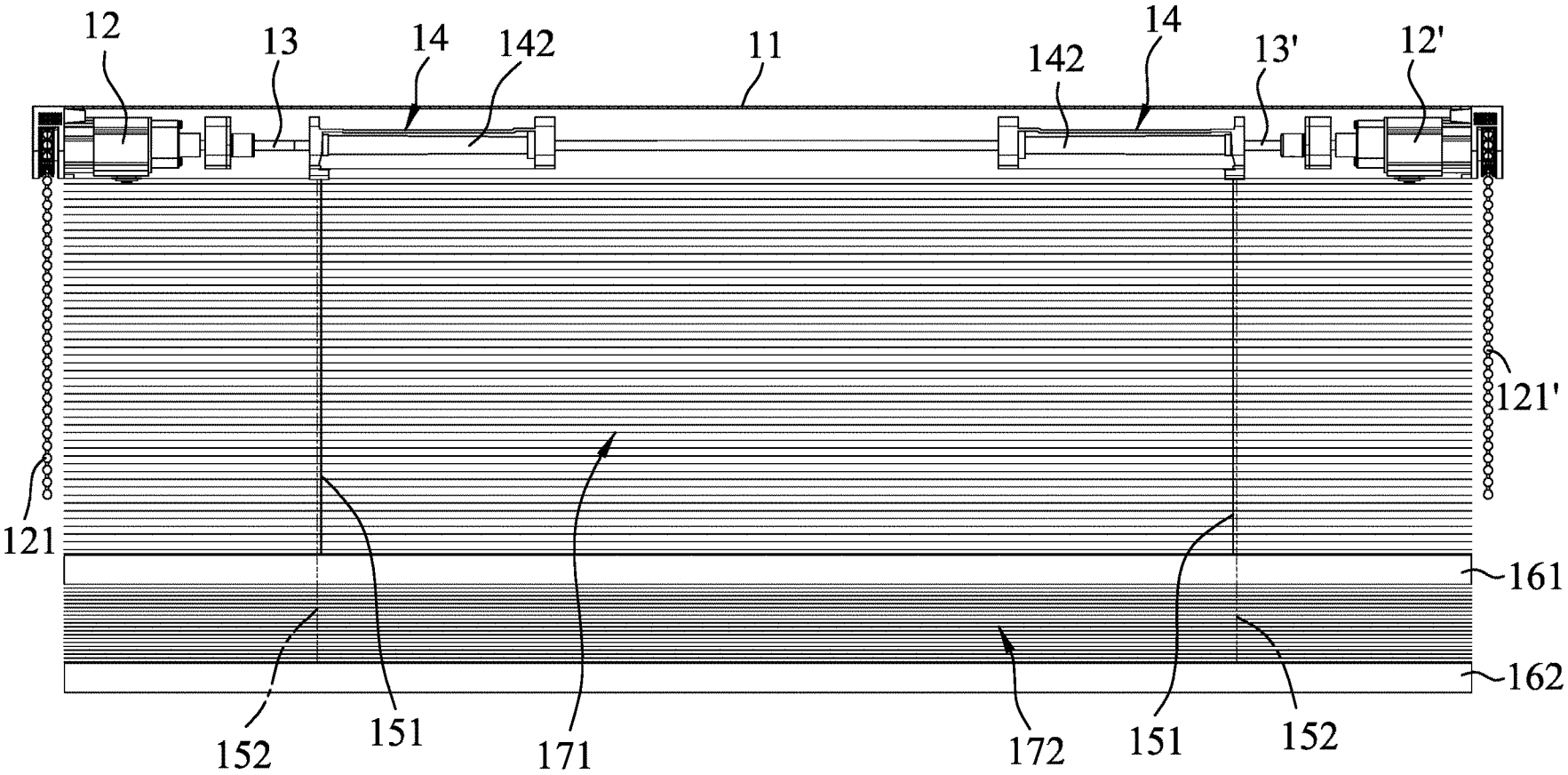
FIG.1 PRIOR ART
FIG. 1 is a front view of a conventional window blind device with partial cross section, illustrating a first shading position.
Figure 2:
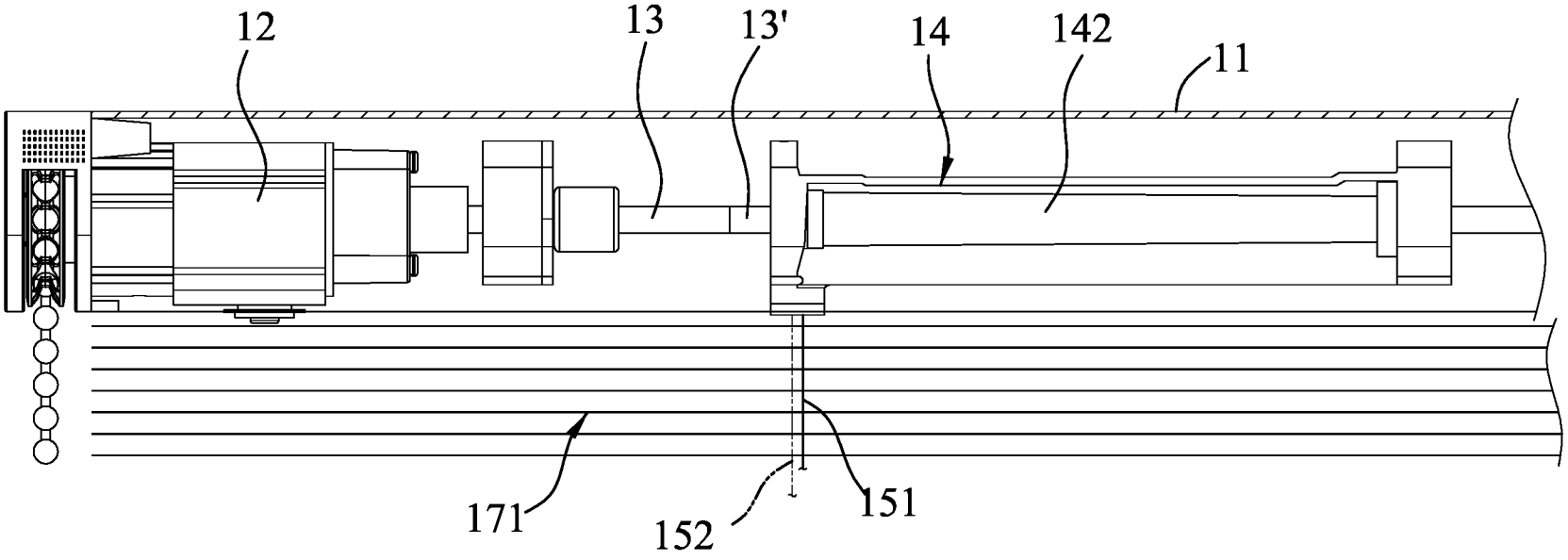
FIG.2 PRIOR ART
FIG. 2 is a fragmentary enlarged view of FIG. 1.
Figure 3:
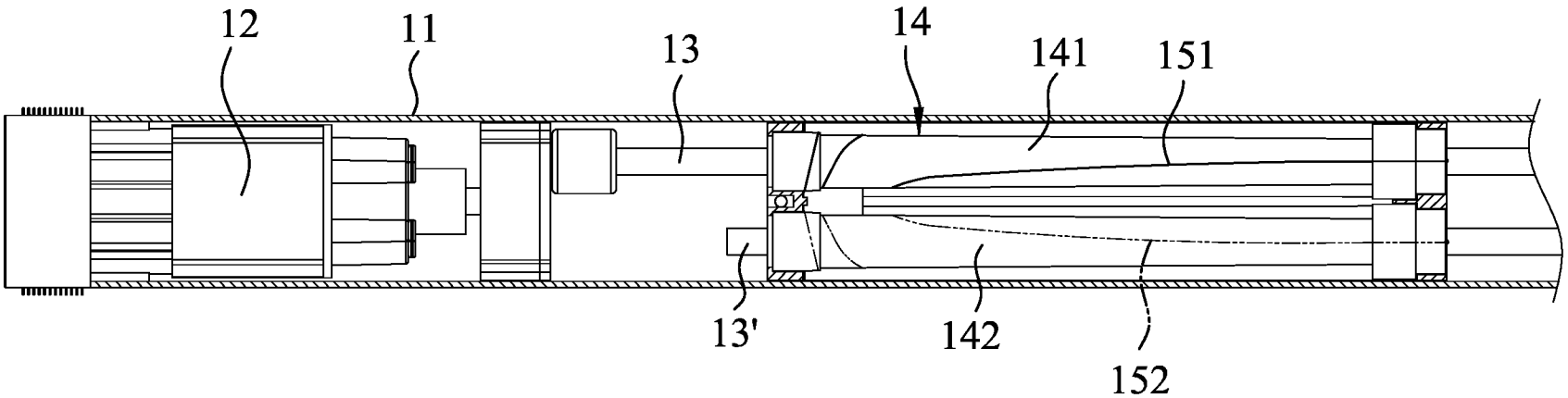
FIG.3 PRIOR ART
FIG. 3 is a fragmentary, top, partially cross-sectional view illustrating a state of a spool unit when the conventional window blind device is in the first shading position.
Figure 4:
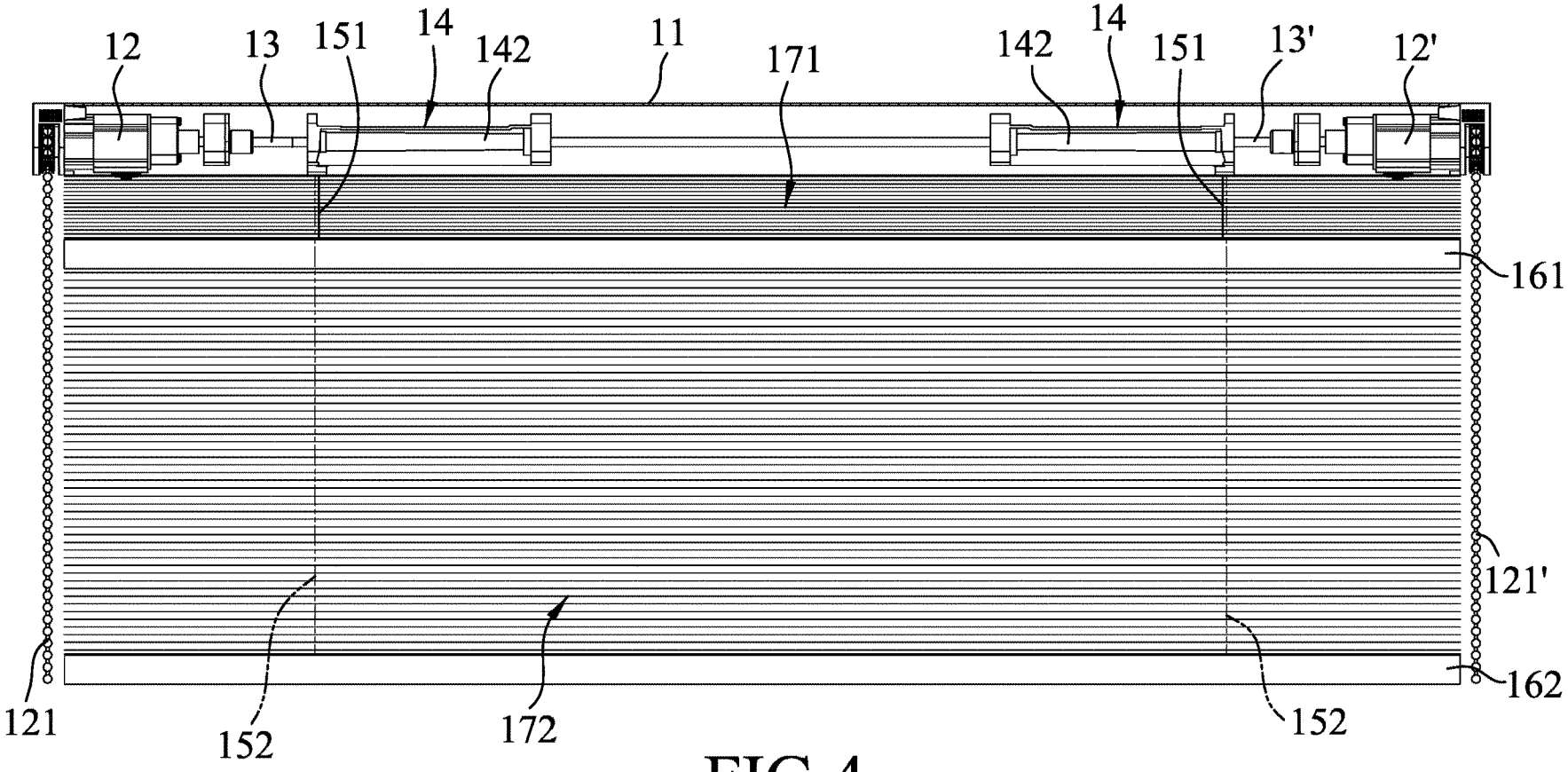
FIG.4 PRIOR ART
FIG. 4 is similar to FIG. 1 but illustrating the conventional window blind device in a second shading position.
Figure 5:
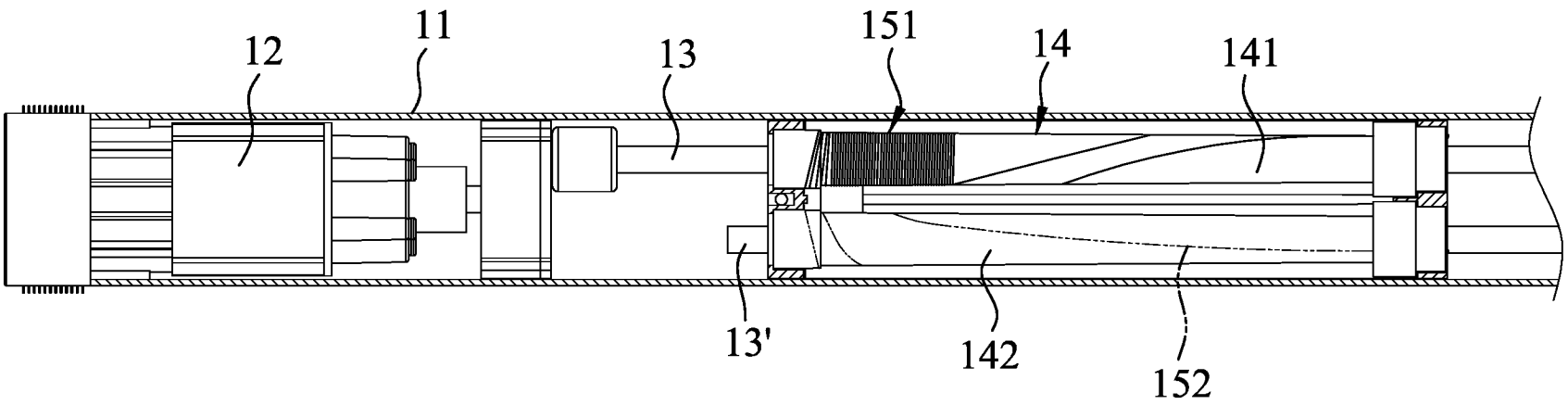
FIG.5 PRIOR ART
FIG. 5 is similar to FIG. 3 but illustrating a state of the spool unit when the conventional window blind device is in the second shading position.
Figure 6:
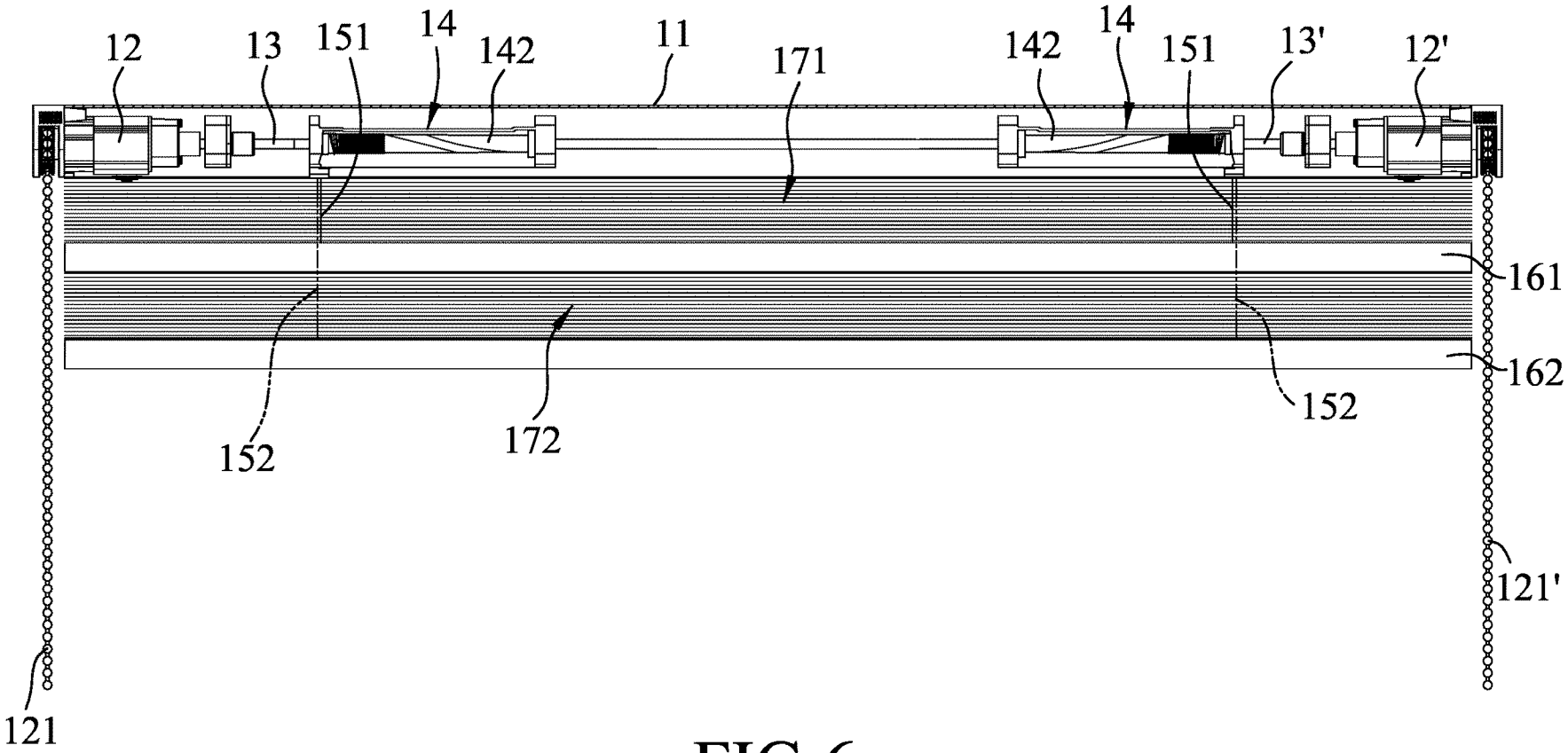
FIG.6 PRIOR ART
FIG. 6 is similar to FIG. 1 but illustrating the conventional window blind device in a fully collapsed position.
Figure 7:
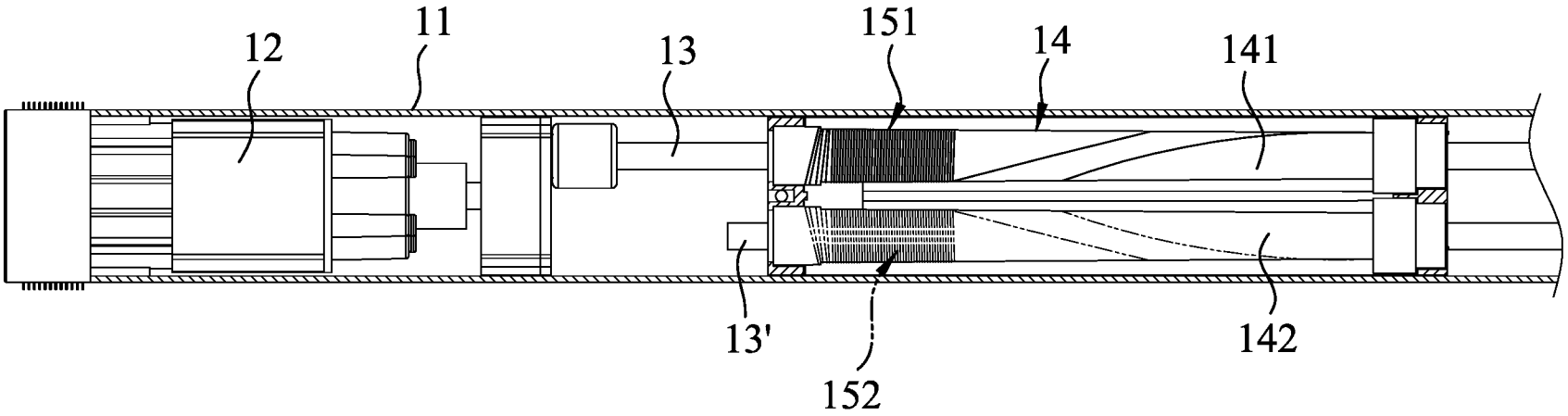
FIG.7 PRIOR ART
FIG. 7 is similar to FIG. 3 but illustrating a state of the spool unit when the conventional window blind device is in the fully collapsed position.
Figure 8:
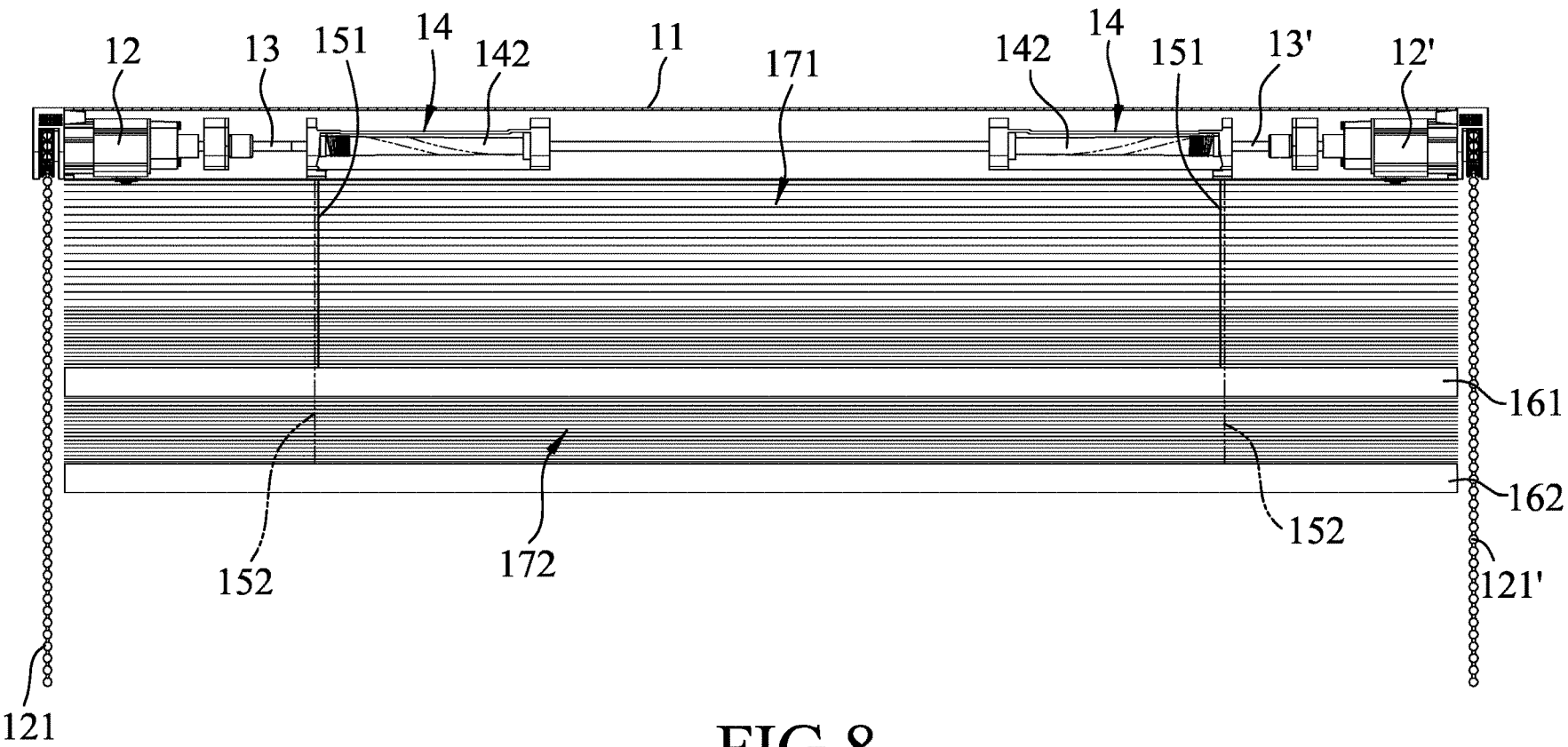
FIG.8 PRIOR ART
FIG. 8 is similar to FIG. 1 but illustrating the conventional window blind device in a partially collapsed position.
Figure 9:
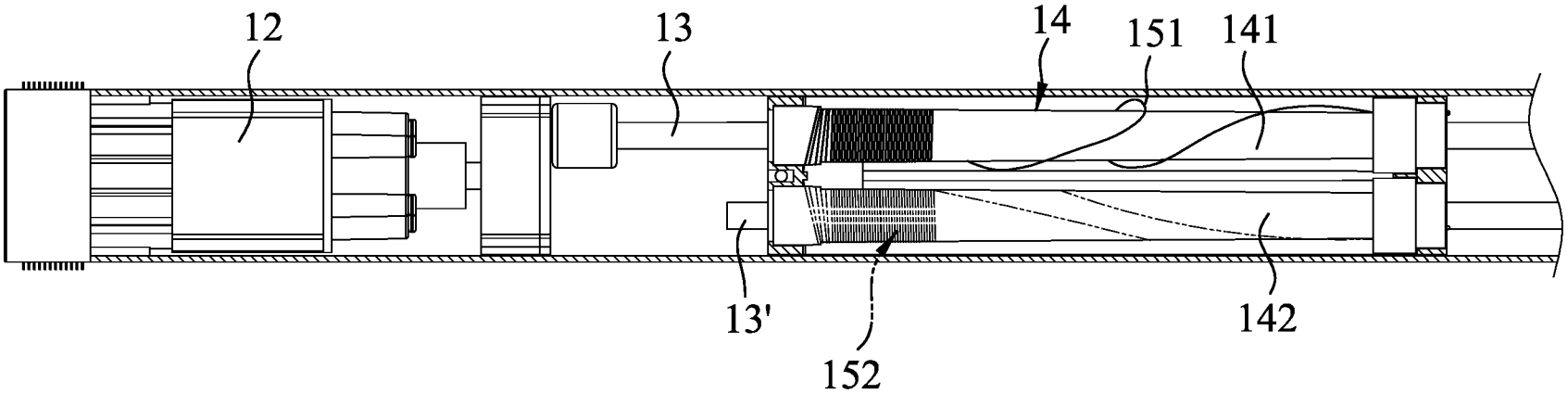
FIG.9 PRIOR ART
FIG. 9 is similar to FIG. 3 but illustrating a state of the spool unit when the conventional window blind device is in the partially collapsed position.

Before the disclosure is described in greater detail, it should be noted that where considered appropriate, reference numerals have been repeated among the figures to indicate corresponding or analogous elements, which may optionally have similar characteristics.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Referring to FIGS. 10 to 13, a controller assembly 900 according to an embodiment of the disclosure is shown to include a housing 2, a first tube unit 3, a second tube unit 4, a first runner 5, and a second runner 6.

Figure 10:
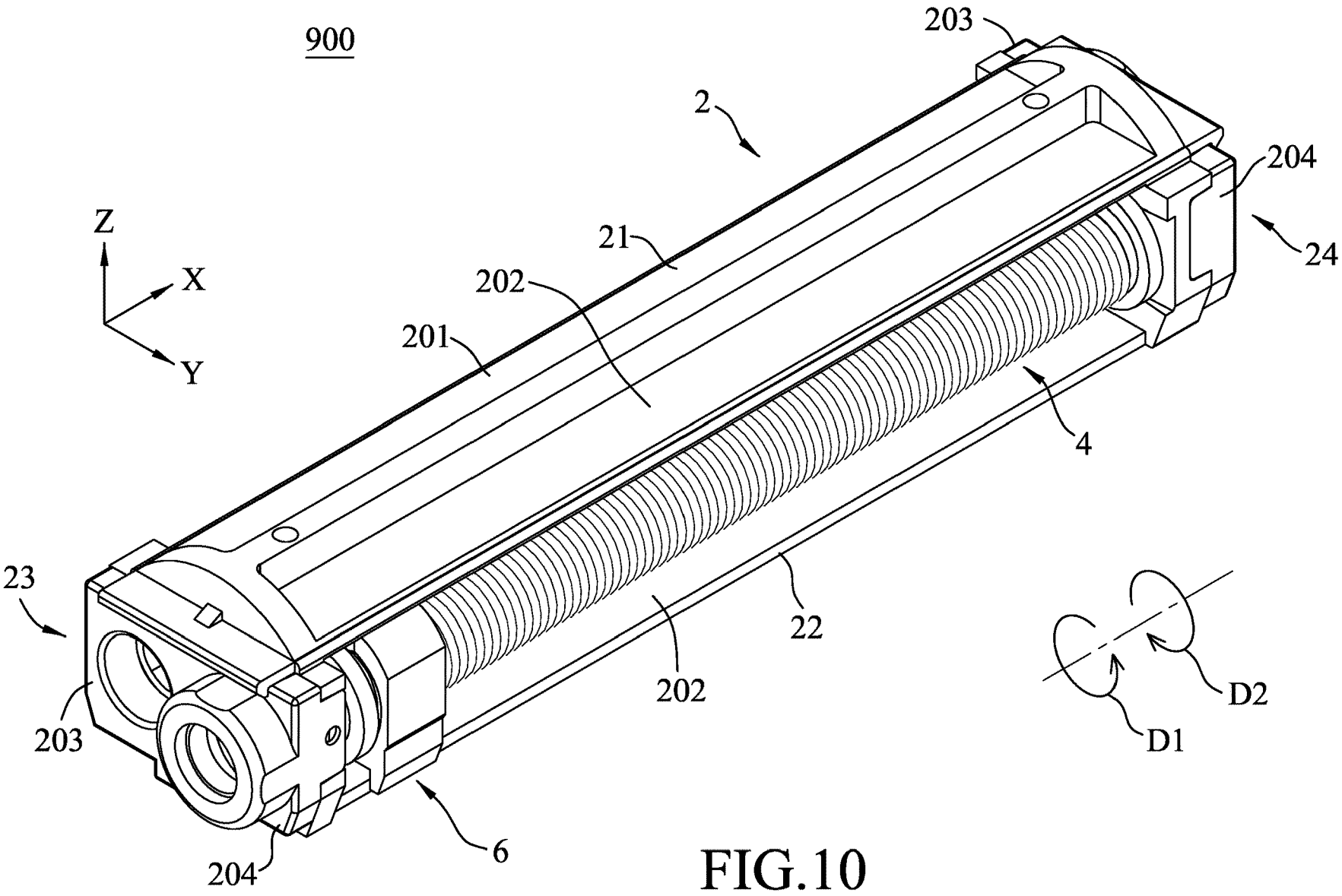
FIG. 10 is a perspective view of a controller assembly according to an embodiment of the disclosure.
Figure 11:
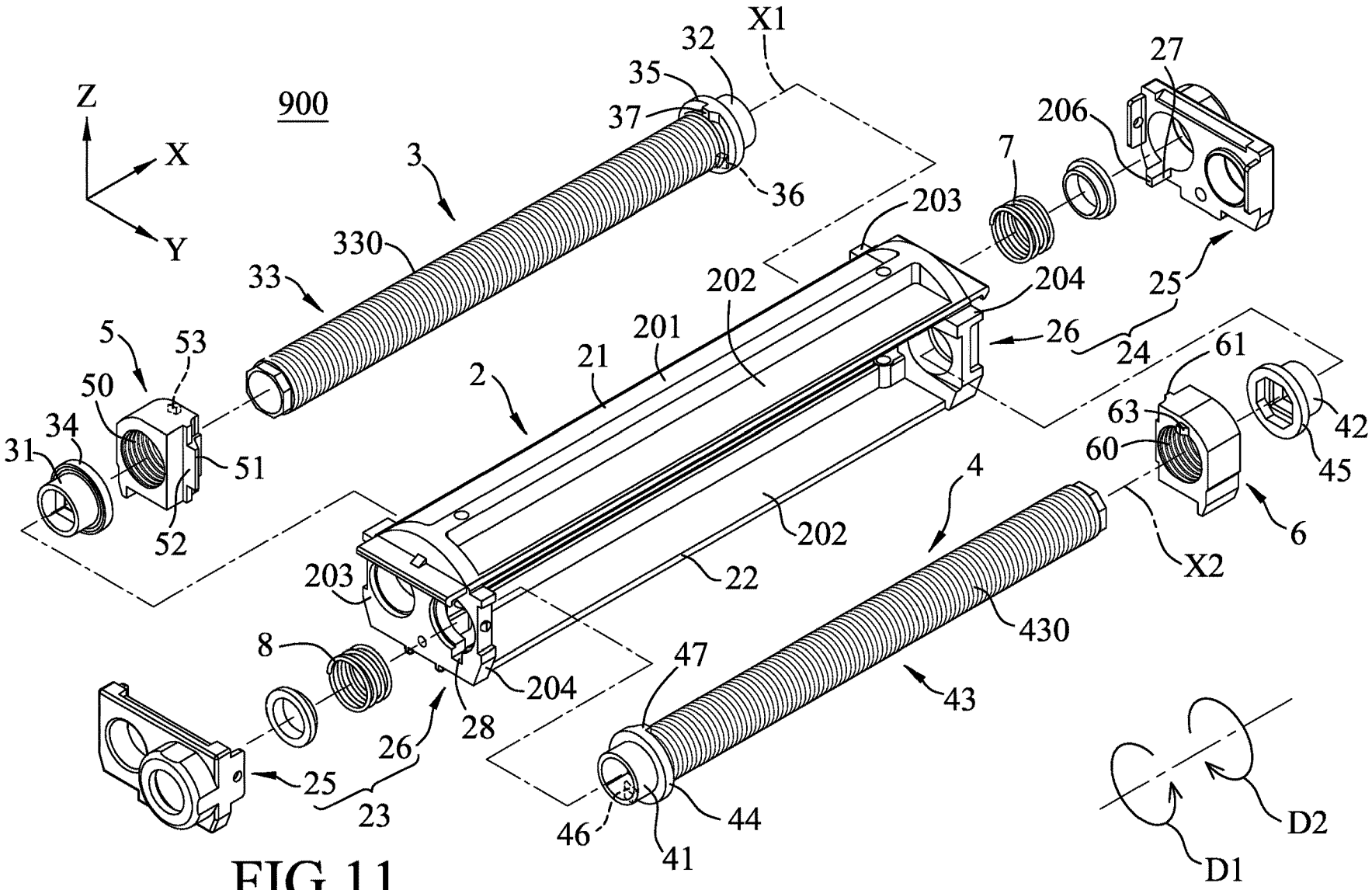
FIG. 11 is an exploded perspective view of the controller assembly.
Figure 13:
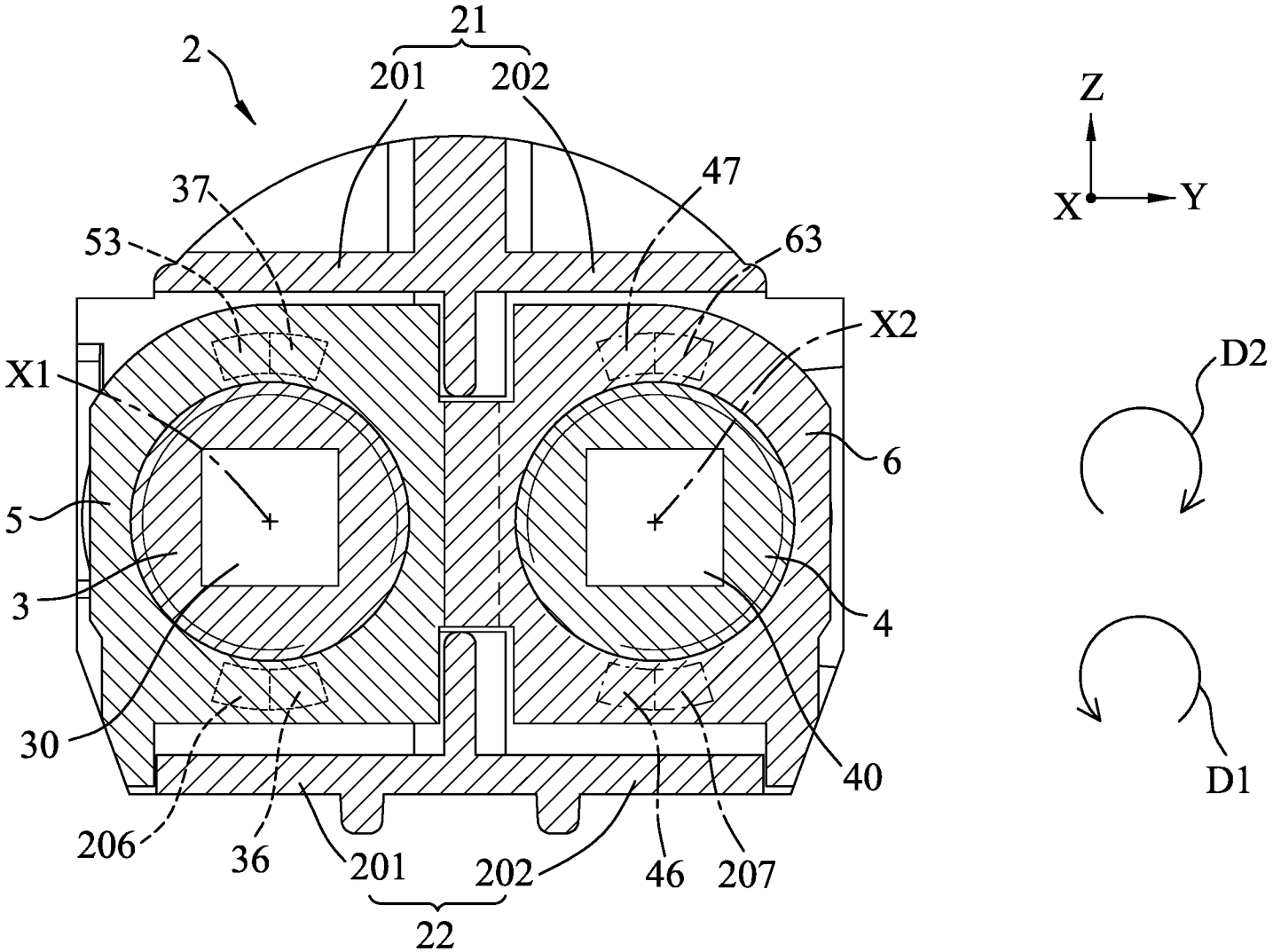
FIG. 13 is a cross-sectional view of the controller assembly along a Y-Z plane.

In an embodiment shown in FIGS. 10, 11, and 13, the housing 2 may include an upper wall 21, a lower wall 22 which is spaced apart from the upper wall 21 in an upright direction (Z), a left wall 23, and a right wall 24 which is spaced apart from the left wall 23 in a left-right direction (X). Each of the upper and lower walls 21, 22 has a first wall segment 201 and a second wall segment 202 opposite to the first wall segment 201 in a front-rear direction (Y). Each of the left and right walls 23, 24 has a third wall segment 203 and a fourth wall segment 204 opposite to the third wall segment 203 in the front-rear direction (Y). As shown in FIG. 13, the upper wall 21 may have a cross-shape cross-section and the lower wall 22 may have an inverse-T shape cross-section.

Figure 12:
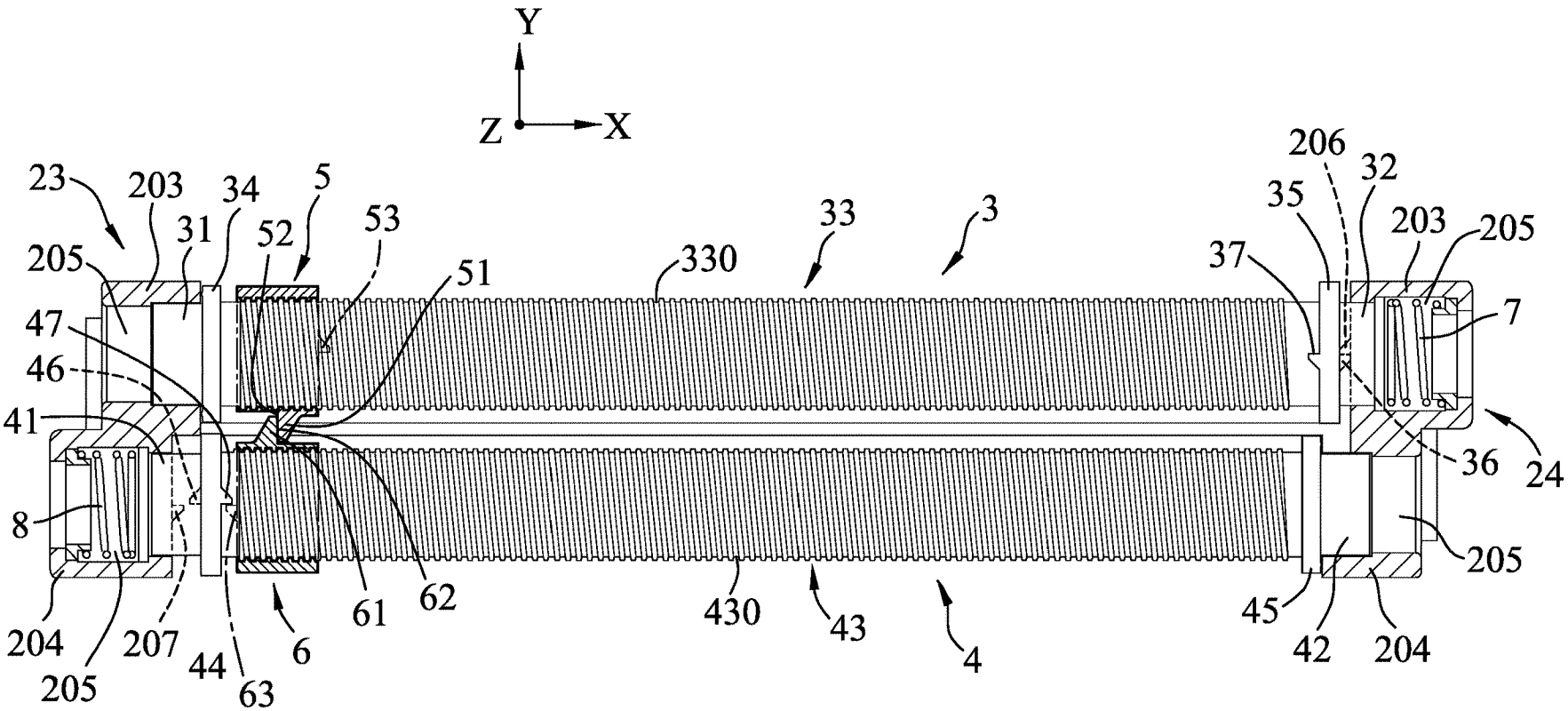
FIG. 12 is a partially cross-sectional view of the controller assembly along an X-Y plane, with some elements omitted.

In an embodiment shown in FIG. 12, each of the third and fourth wall segments 203, 204 of the left and right walls 23, 24 is formed with a through bore 205.

In an embodiment shown in FIGS. 11 and 12, a first locking pin 206 is provided inside the housing 2 on the third wall segment 203 of the right wall 24, and a second locking pin 207 is provided inside the housing 2 on the fourth wall segment 204 of the left wall 23.

In an embodiment shown in FIGS. 11 and 12, each of the left and right walls 23, 24 may be formed by snap-fitting of an outer wall part 25 to an inner wall part 26. A first elongated pin 27, provided on the outer wall part 25 of the right wall 24, is inserted through a first hole (not shown, having a similar configuration as a second hole 28 mentioned below) of the inner wall part 26 of the right wall 24 to serve as the first locking pin 206 inside the housing 2. A second elongated pin (not shown, having a similar configuration as the first elongated pin 27), provided on the outer wall part 25 of the left wall 24, is inserted through the second hole 28 of the inner wall part 26 of the left wall 24 to serve as the second locking pin 207.

In an embodiment shown in FIG. 11, the left and right walls 23, 24 may have the same configuration, but have inverse orientations with respect to each other in the left-right direction (X).

The first tube unit 3 has a first outer threaded surface 330, and is rotatably retained in the housing 2. The first tube unit 3 is coupled to be driven by a first drive shaft 921 (see FIGS. 14 and 16) to rotate about a first axis (X1) which extends in the left-right direction (X).

In an embodiment shown in FIGS. 11 and 12, the first tube unit 3 is configured to be rotatably retained between the third wall segments 203 of the left and right walls 23, 24.

In an embodiment shown in FIGS. 11 and 12, the first tube unit 3 may include a first left tubular stem 31, a first right tubular stem 32, and a first screw tube 33. The first left tubular stem 31 is configured to be rotatably received in the through bore 205 of the third wall segment 203 of the left wall 23. The first right tubular stem 32 is configured to be rotatably received in the through bore 205 of the third wall segment 203 of the right wall 24. The first screw tube 33 is disposed between the first left and right tubular stems 31, 32, and has the first outer threaded surface 330.

In an embodiment shown in FIGS. 11 and 12, the first tube unit 3 may further include a first left outer flange 34 and a first right outer flange 35. The first left outer flange 34 is provided between the first left tubular stem 31 and the first screw tube 33 to prevent insertion of the first screw tube 33 into the through bore 205 of the third wall segment 203 of the left wall 23. The first right outer flange 35 is provided between the first right tubular stem 32 and the first screw tube 33 to prevent insertion of the first screw tube 33 into the through bore 205 of the third wall segment 203 of the right wall 24.

In an embodiment shown in FIGS. 11 and 12, the first tube unit 3 may further include a first locked peg 36 provided on a right surface of the first right outer flange 35, and a leftward locked peg 37 provided on a left surface of the first right outer flange 35.

The second tube unit 4 has a second outer threaded surface 430, and is rotatably retained in the housing 2. The second tube unit 4 is spaced apart from the first tube unit 3 in the front-rear direction (Y), and is coupled to be driven by a second drive shaft 922 (see FIGS. 14 and 16) to rotate about a second axis (X2) which extends in the left-right direction (X).

In an embodiment shown in FIGS. 11 and 12, the second tube unit 4 is configured to be rotatably retained between the fourth wall segments 204 of the left and right walls 23, 24.

In an embodiment shown in FIGS. 11 and 12, the second tube unit 4 may include a second left tubular stem 41, a second right tubular stem 42, and a second screw tube 43. The second left tubular stem 41 is configured to be rotatably received in the through bore 205 of the fourth wall segment 204 of the left wall 23. The second right tubular stem 42 is configured to be rotatably received in the through bore 205 of the fourth wall segment 204 of the right wall 24. The second screw tube 43 is disposed between the second left and right tubular stems 41, 42, and has the second outer threaded surface 430.

In an embodiment shown in FIGS. 11 and 12, the second tube unit 4 may further include a second left outer flange 44 and a second right outer flange 45. The second left outer flange 44 is provided between the second left tubular stem 41 and the second screw tube 43 to prevent insertion of the second screw tube 43 into the through bore 205 of the fourth wall segment 204 of the left wall 24. The second right outer flange 45 is provided between the second right tubular stem 42 and the second screw tube 43 to prevent insertion of the second screw tube 43 into the through bore 205 of the fourth wall segment 204 of the right wall 24.

In an embodiment shown in FIGS. 11 and 12, the second tube unit 4 may further include a second locked peg 46 provided on a left surface of the second left outer flange 44, and a rightward locked peg 47 provided on a right surface of the second left outer flange 44.

In an embodiment shown in FIG. 11, the first and second tube units 3, 4 may have the same configuration, but have inverse orientations with respect to each other in the left-right direction (X).

The first runner 5 has a first inner threaded bore 50 configured to be in threaded engagement with the first outer threaded surface 330 of the first tube unit 3. The first runner 5 is retained to slide along the first axis (X1) when the first tube unit 3 is driven to rotate about the first axis (X1). The second runner 6 has a second inner threaded bore 60 configured to be in threaded engagement with the second outer threaded surface 430 of the second tube unit 4. The second runner 6 is retained to slide along the second axis (X2) when the second tube unit 6 is driven to rotate about the second axis (X2).

The first and second runners 5, 6 are configured to be brought into abutment with each other in the left-right direction (X), as shown in FIGS. 12, 16, 22, 25, and 26. In response to leftward sliding of the first runner 5 to bring the first runner 5 into abutment with the second runner 6, the first runner 5 is prevented from sliding leftward over the second runner 6, whilst impeding rotation of the first tube unit 3. In response to rightward sliding of the second runner 6 to bring the second runner 6 into abutment with the first runner 5, the second runner 6 is prevented from sliding rightward over the first runner 5, whilst impeding rotation of the second tube unit 4.

Figure 19:
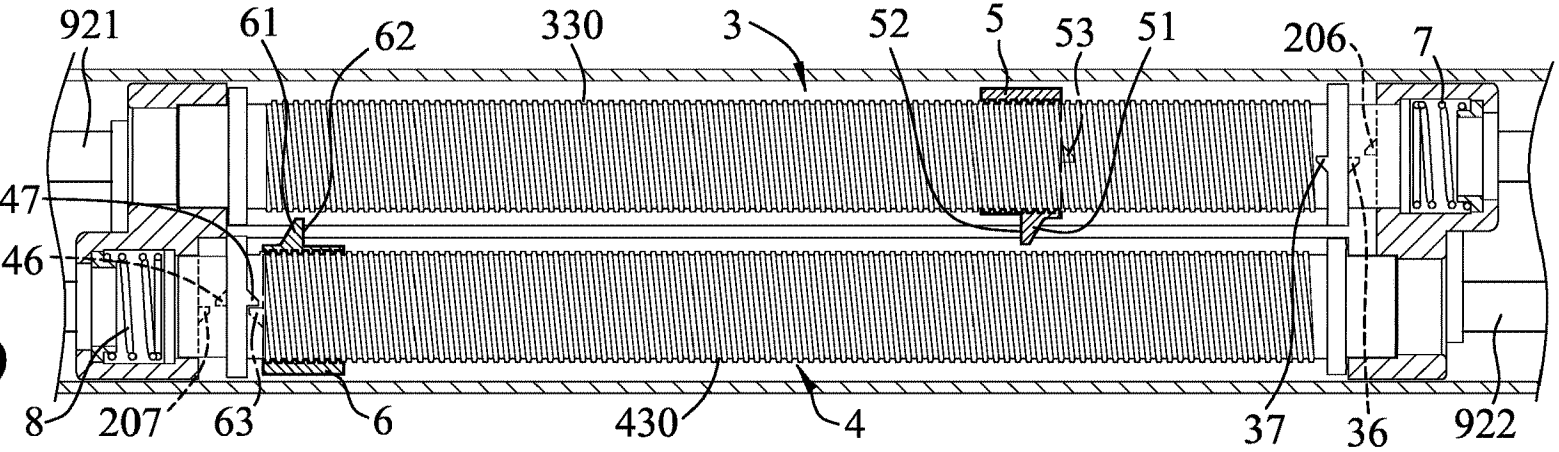
FIG. 19 is similar to FIG. 16 but illustrating a state of the controller assembly when the window blind apparatus is in the second shading position.
Figure 20:
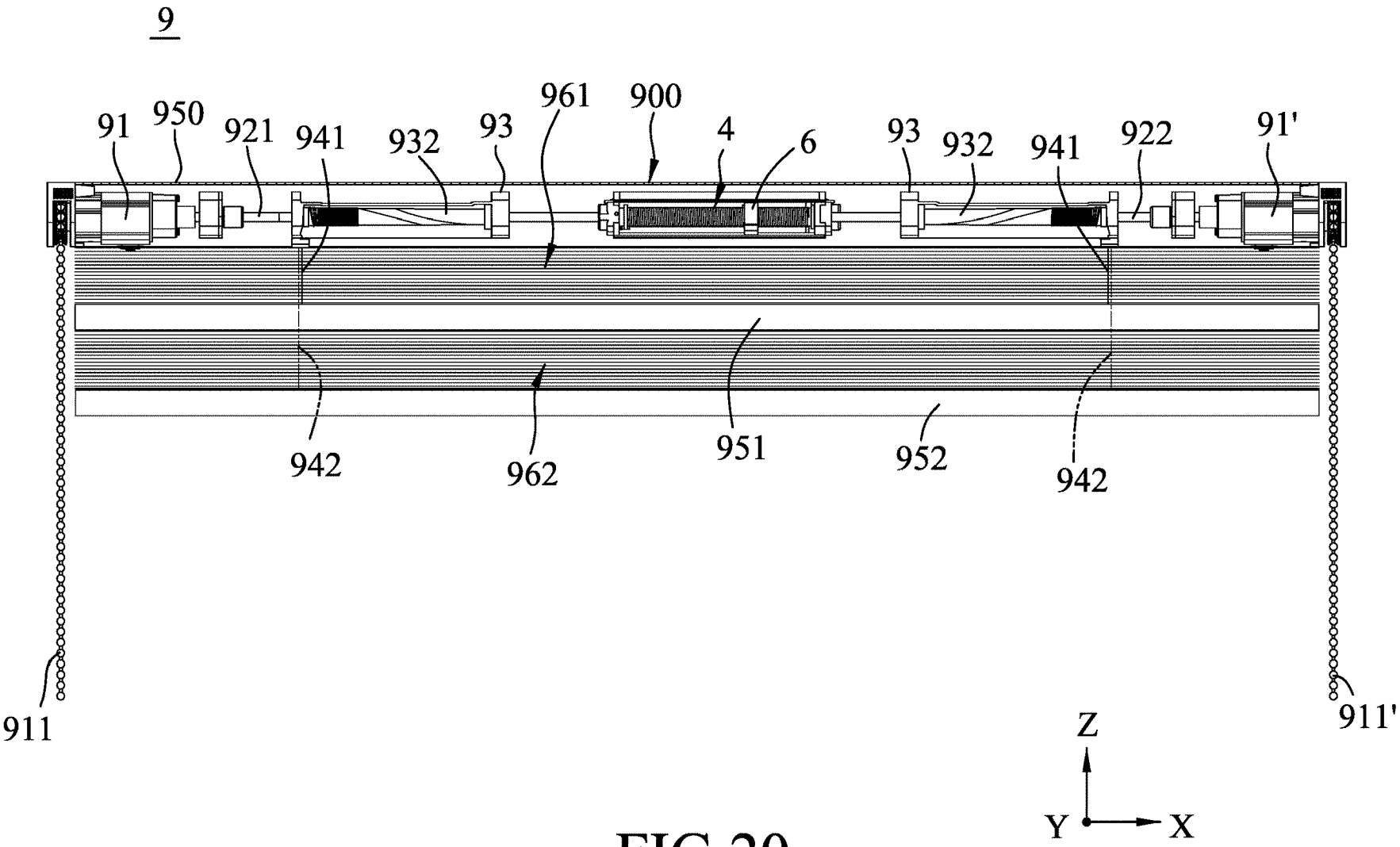
FIG. 20 is similar to FIG. 14 but illustrating the window blind apparatus in a fully collapsed position.
Figure 21:
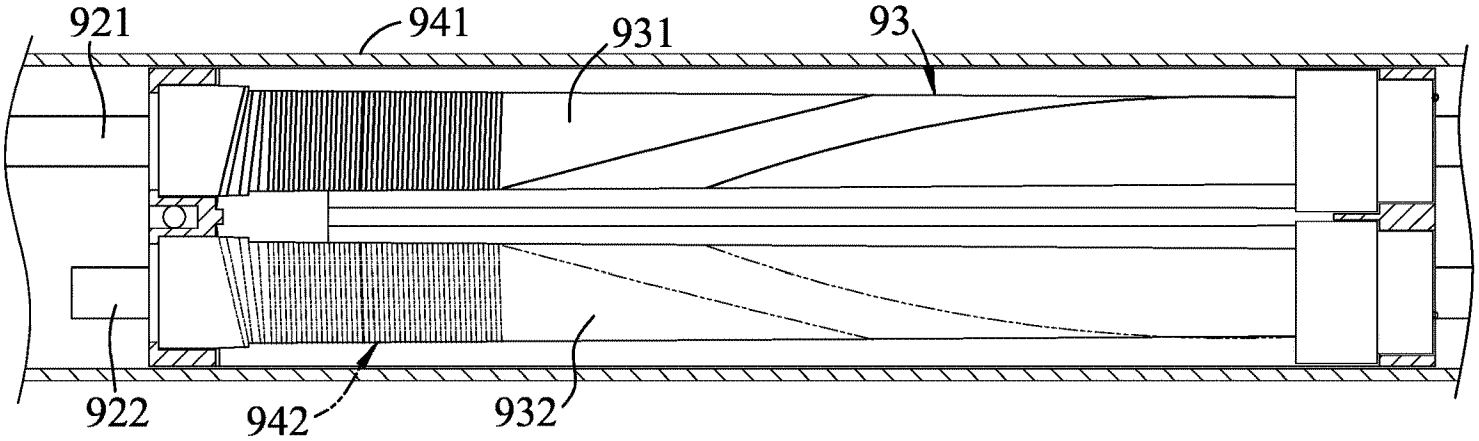
FIG. 21 is similar to FIG. 15 but illustrating a state of the spool unit when the window blind apparatus is in the fully collapsed position.

In an embodiment shown in FIGS. 11, 12, and 19, the first runner 5 is formed with a first stop tab 51 which has a leftward abutment surface 52, and the second runner 6 is formed with a second stop tab 61 which has a rightward abutment surface 62. The leftward and rightward abutment surfaces 52, 62 are configured to be brought into abutment with each other in the left-right direction (X) when the first and second runners 5, 6 are in abutment with each other.

Figure 22:
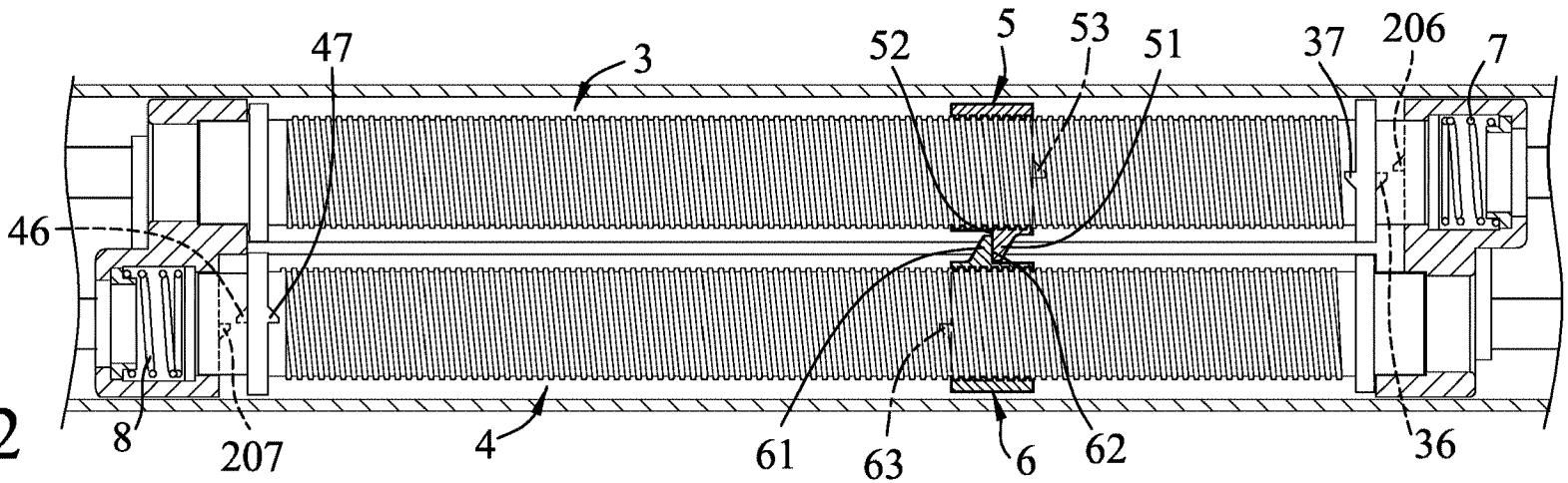
FIG. 22 is similar to FIG. 16 but illustrating a state of the controller assembly when the window blind apparatus is in the fully collapsed position.
Figure 23:
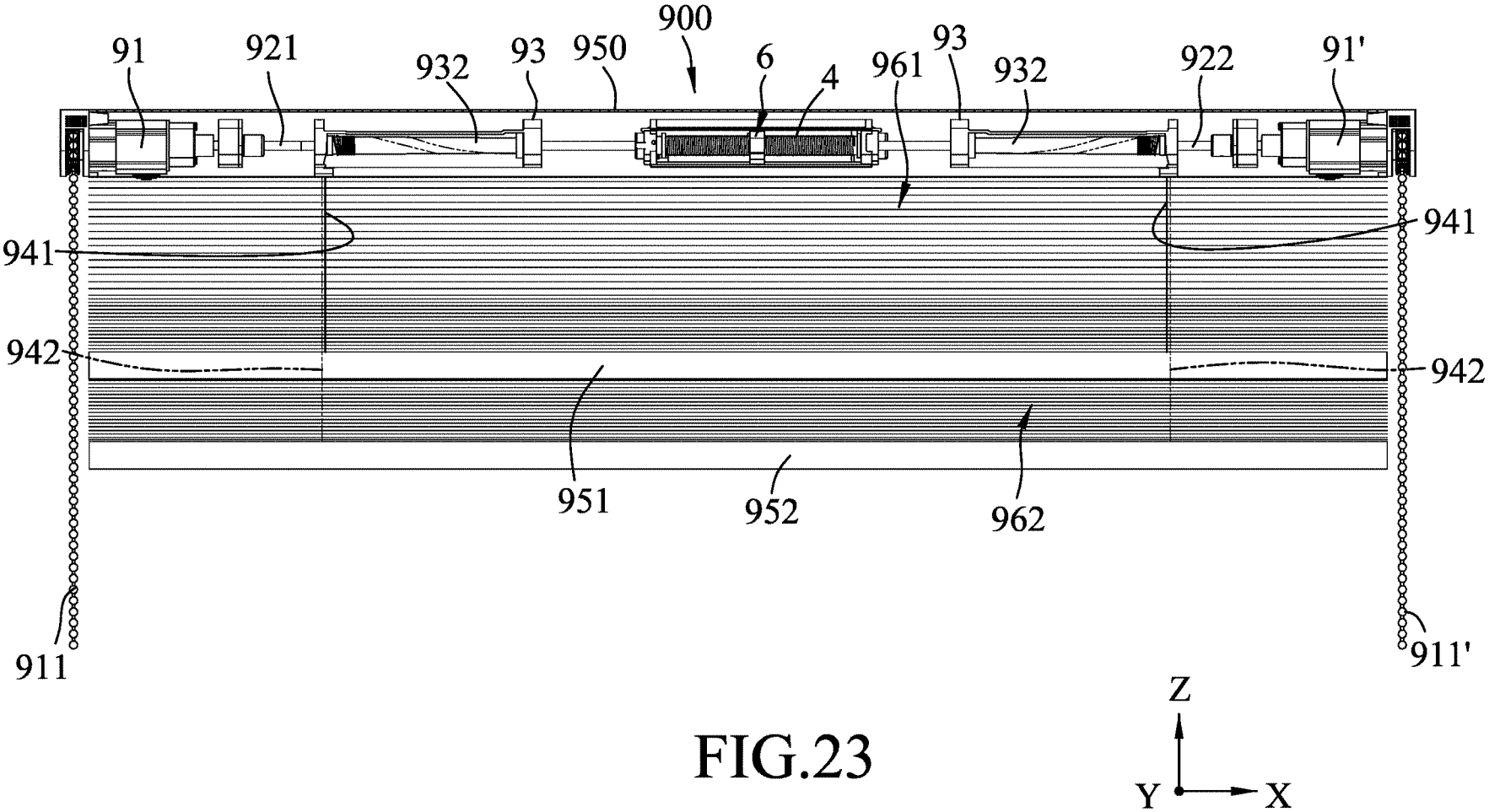
FIG. 23 is similar to FIG. 14 but illustrating the window blind apparatus in a partially collapsed position.
Figure 24:
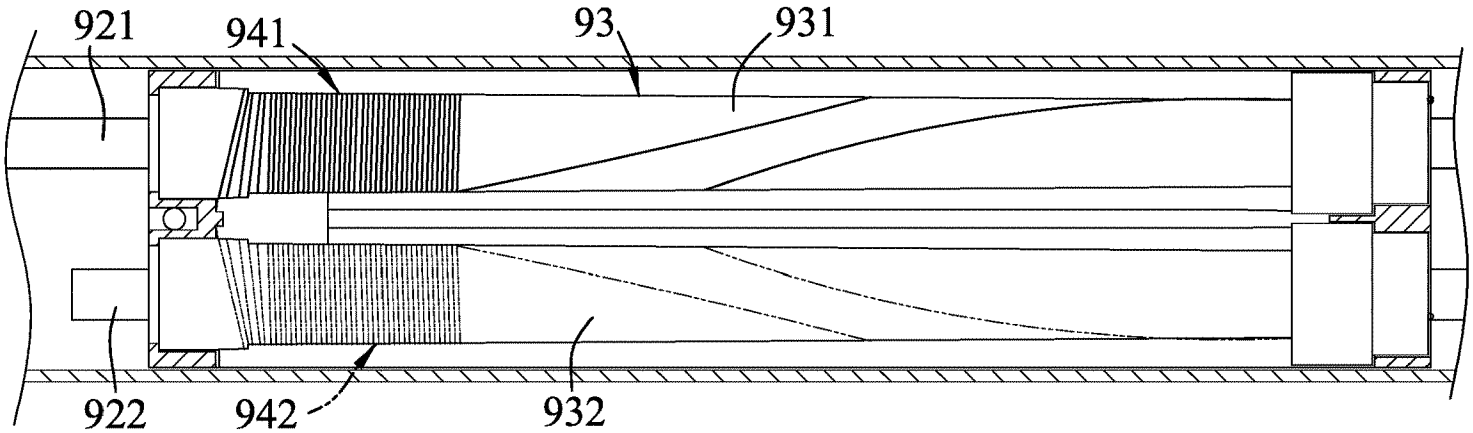
FIG. 24 is similar to FIG. 15 but illustrating a state of the spool unit when the window blind apparatus is in the partially collapsed position.

In an embodiment shown in FIGS. 10 to 13, when the first tube unit 3 is driven to rotate, the first runner 5 is retained by the housing 2 to slide between a first left end position (FIGS. 12 and 16) and a first right end position (FIGS. 19 and 22). When the second tube unit 4 is driven to rotate, the second runner 6 is retained by the housing 2 to slide between a second left end position (FIGS. 12, 16, and 19) and a second right end position (FIG. 22). When the first runner 5 is in the first left position (FIGS. 12 and 16), the second runner 6 is kept in the second left position with the rightward abutment surface 62 in abutment with the leftward abutment surface 52. When the second runner 6 is in the second right position (FIG. 22), the first runner 5 is kept in the first right position with the leftward abutment surface 52 in abutment with the rightward abutment surface 62.

In an embodiment shown in FIGS. 11 and 13, the first runner 5 is configured to be slidably and fittingly retained between the first wall segments 201 of the upper and lower walls 21, 22, and the second runner 6 is configured to be slidably and fittingly retained between the second wall segments 202 of the upper and lower walls 21, 22.

In an embodiment shown in FIGS. 11 and 12, the first runner 5 may be formed with a rightward locking pin 53 and the second runner 6 may be formed with a leftward locking pin 63.

In an embodiment shown in FIG. 11, the first and second runners 5, 6 may have the same configuration, but have inverse orientations with respect to each other in the left-right direction (X).

In an embodiment shown in FIGS. 11 and 12, the controller assembly 900 may further include a first biasing spring 7 and a second biasing spring 8. The first biasing spring 7 is disposed in the through bore 205 of the third wall segment 203 of the right wall 24 to bias the first right outer flange 35 away from the third wall segment 203 of the right wall 24. The second biasing spring 8 is disposed in the through bore 205 of the fourth wall segment 204 of the left wall 23 to bias the second left outer flange 44 away from the fourth wall segment 204 of the left wall 23. As shown in FIG. 11, the first biasing spring 7 may be disposed between the outer wall part 25 of the right wall 24 and the first right tubular stem 32, and the second biasing spring 8 may be disposed between the outer wall part 25 of the left wall 23 and the second left tubular stem 41.

Figure 16:
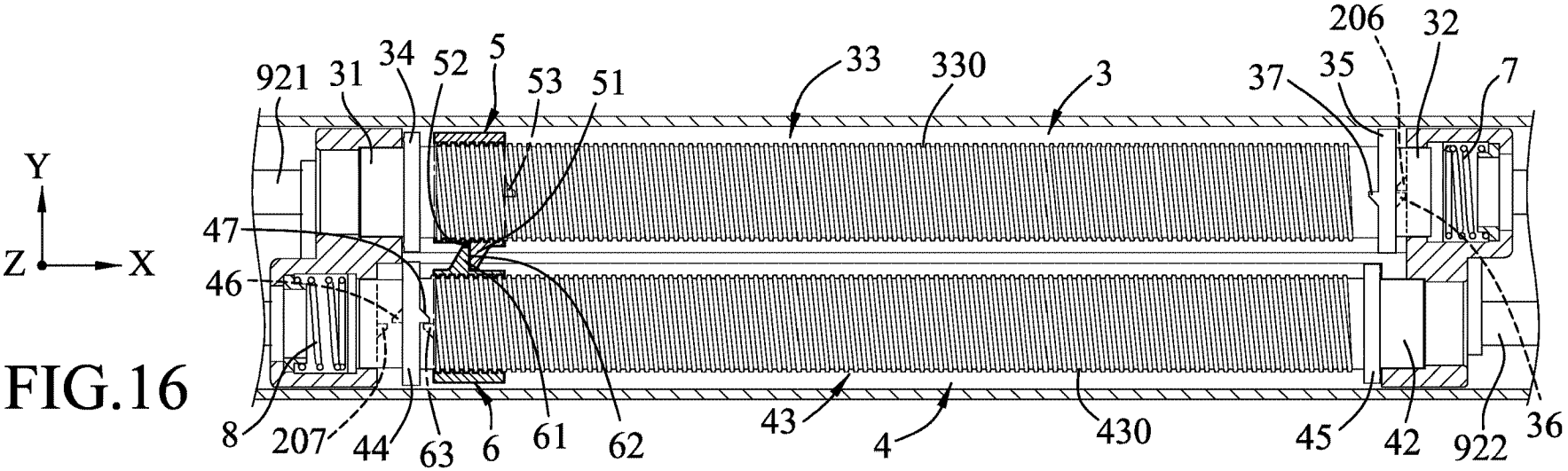
FIG. 16 is a fragmentary, top, partially cross-sectional view along the X-Y plane, illustrating a state of the controller assembly when the window blind apparatus is in the first shading position.
Figure 17:
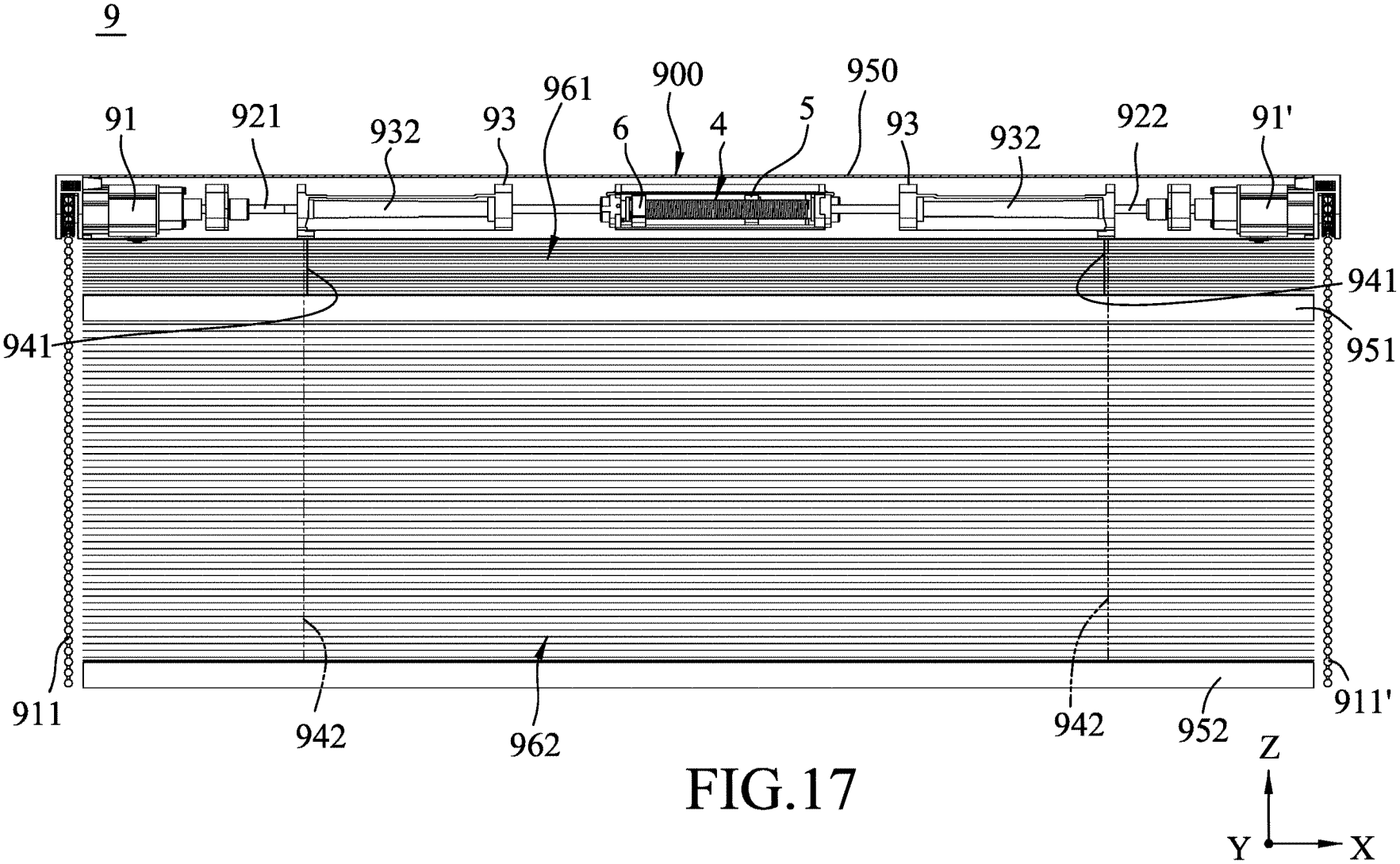
FIG. 17 is similar to FIG. 14 but illustrating the window blind apparatus in a second shading position.
Figure 18:
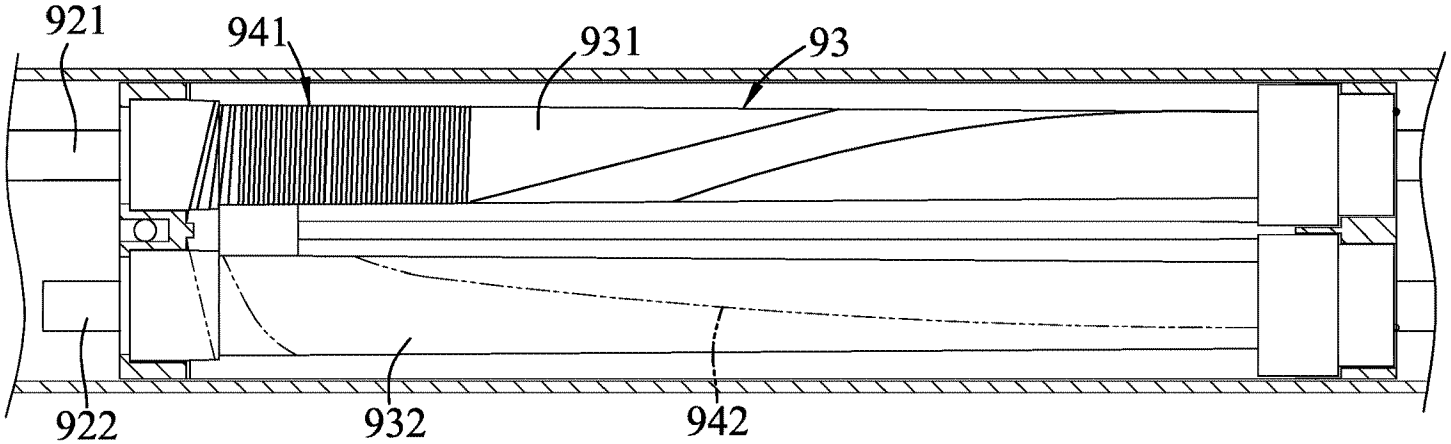
FIG. 18 is similar to FIG. 15 but illustrating a state of the spool unit when the window blind apparatus is in the second shading position.
Figure 25:
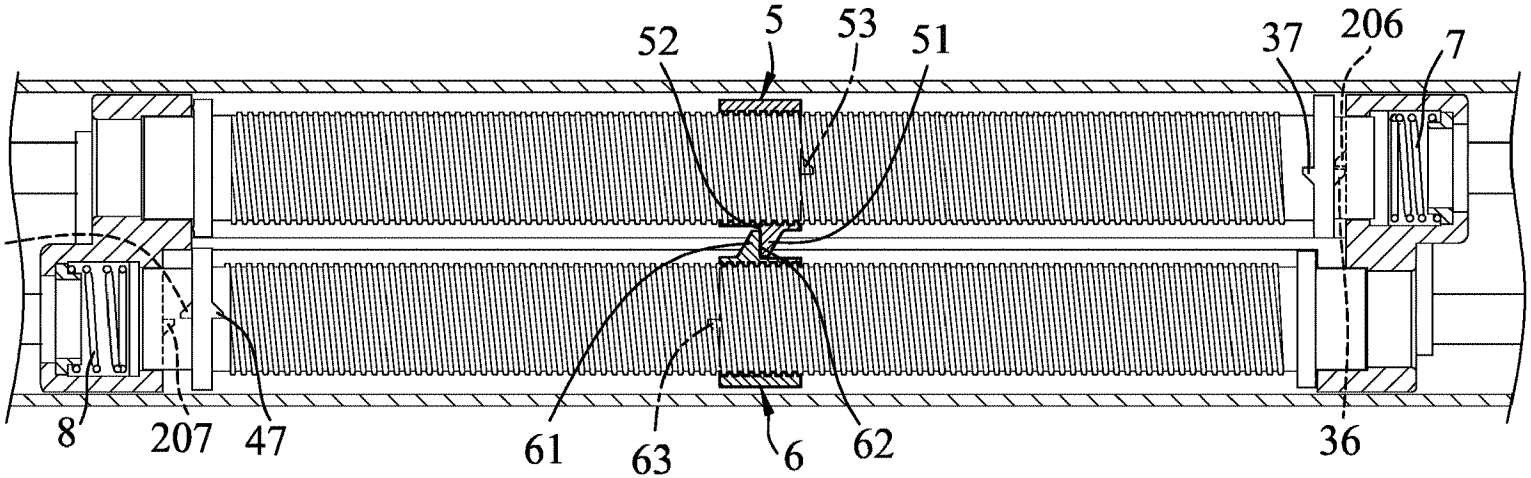
FIG. 25 is similar to FIG. 16 but illustrating a state of the controller assembly when the window blind apparatus is in the partially collapsed position.

In an embodiment shown in FIGS. 12, 16, and 25, once the first runner 5 is moved to bring the leftward abutment surface 52 into abutment with the rightward abutment surface 62, the first tube unit 3 is permitted to move rightward against a biasing force of the first biasing spring 7 to bring the first locked peg 36 into locking engagement with the first locking pin 206 so as to further impede rotation of the first tube unit 3.

Figure 26:
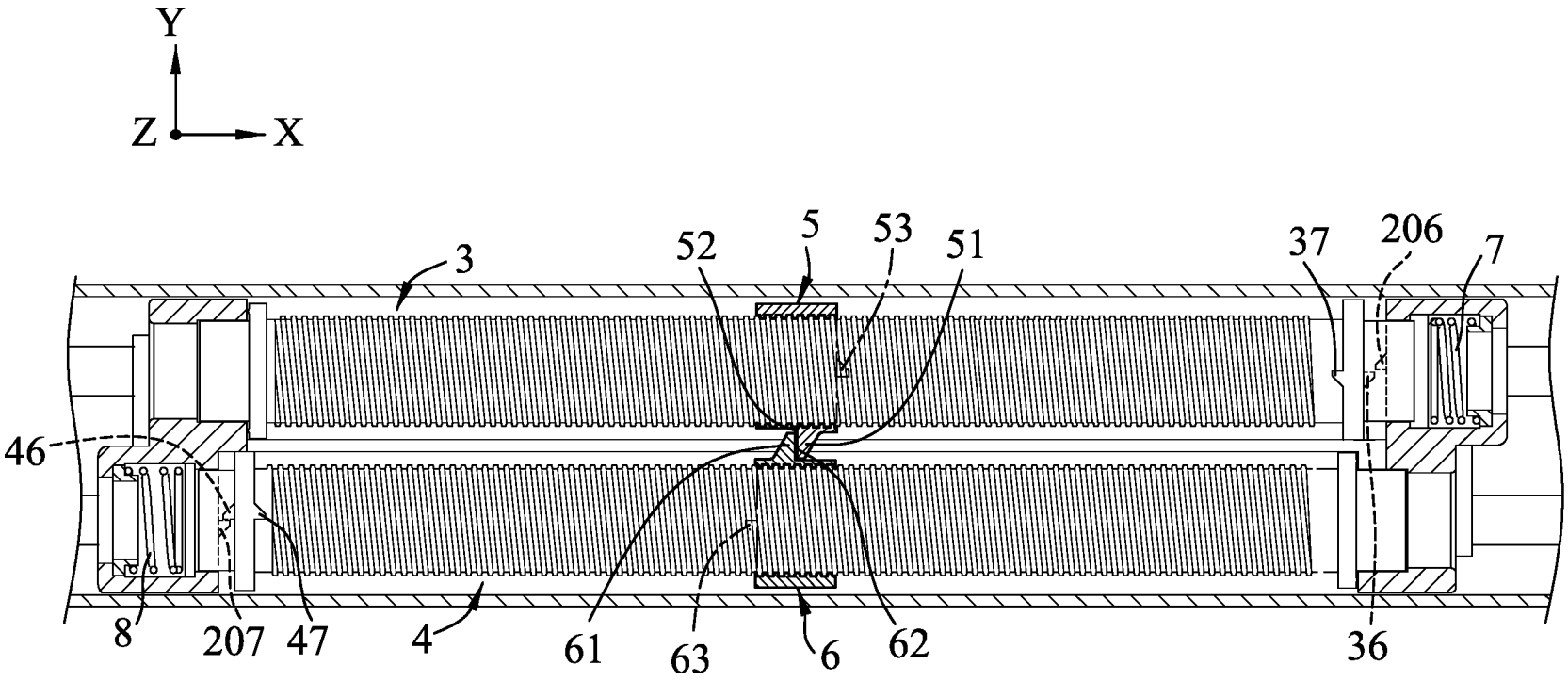
FIG. 26 is similar to FIG. 25 but illustrating another state of the controller assembly when the window blind apparatus is in the partially collapsed position.

In an embodiment shown in FIG. 26, once the second runner 6 is moved to bring the rightward abutment surface 62 into abutment with the leftward abutment surface 52, the second tube unit 4 is permitted to move leftward against a biasing force of the second biasing spring 8 to bring the second locked peg 46 into locking engagement with the second locking pin 207 so as to further impede rotation of the second tube unit 4.

In an embodiment shown in FIGS. 12, 16, and 19, once the second runner 6 is moved to the second left position, the rightward locked peg 47 is permitted to be brought into locking engagement with the leftward locking pin 63 so as to impede rotation of the second tube unit 4.

In an embodiment shown in FIGS. 14 to 26, the controller assembly 900 is used for controlling operation of a window blind apparatus 9. The window blind apparatus 9 may include a headrail 950, a middlerail 951, a bottomrail 952, a first cellular shade 961, a second cellular shade 962, a first force output member 91, a first actuating cord 911, a first drive shaft 921, a second force output member 91', a second actuating cord 911', a second drive shaft 922, two spool units 93, two first lift cords 941, and two second lift cords 942. The first cellular shade 961 is connected between the headrail 950 and the middlerail 951. The second cellular shade 962 is connected between the middlerail 951 and the bottomrail 952. The first and second force output members 91, 91' are disposed in the headrail 950 and are spaced apart from each other in the left-right direction (X). The first and second drive shafts 921, 922 are respectively coupled to be driven by the first and second force output members 91, 91' to rotate. The first force output member 91 is actuated by the first actuating cord 911 to output a rotational force for driving rotation of the first drive shaft 921. The second force output member 91' is actuated by the second actuating cord 911' to output a rotational force for driving rotation of the second drive shaft 922. The spool units 93 are disposed in the headrail 950 at two opposite sides of the controller assembly 900. Each of the spool units 93 includes a first tubular spool 931 and a second tubular spool 932 which are respectively sleeved on and rotate with the first and second drive shafts 921, 922. Each of the first lift cords 941 has two first cord ends, one of which is connected to the first tubular spool 931 of a respective one of the spool units 93, and the other one of which is connected to a respective one of left and right segments of the middlerail 951. Each of the second lift cords 942 has two second cord ends, one of which is connected to the second tubular spool 932 of a respective one of the spool units 93, and the other one of which is connected to a respective one of left and right segments of the bottomrail 952.

In other not-shown embodiments, each of the first and second force output members 91, 91' maybe a drive motor for outputting rotation force, and the first and second actuating cords 911, 911' may be omitted.

In an embodiment shown in FIGS. 12 to 15, each of the first tube unit 3 and the first tubular spools 931 of the spool units 93 has an elongated hole 30 which is square-shaped in cross section (only the elongated hole 30 of the first tube unit 3 is shown in FIG. 13), and the first drive shaft 921 is also square-shaped in cross-section and is fittingly inserted through the first tube unit 3 and the first tubular spools 931 of the spool units 93 so as to permit the first tube unit 3 and the first tubular spools 931 to rotate with the first drive shaft 921.

In addition, each of the second tube unit 4 and the second tubular spools 932 of the spool units 93 has an elongated hole 40 which is square-shaped in cross section (only the elongated hole 40 of the second tube unit 4 is shown in FIG. 13), and the second drive shaft 922 is also square-shaped in cross-section and is fittingly inserted through the second tube unit 4 and the second tubular spools 932 of the spool units 93 so as to permit the second tube unit 4 and the second tubular spools 932 to rotate with the second drive shaft 922.

The window blind apparatus 9 is transformable among a first shading position (FIGS. 14 to 16), a second shading position (FIGS. 17 to 19), a fully collapsed position (FIGS. 20 to 22), and a partially collapsed position (FIGS. 23 to 26).

Figure 14:
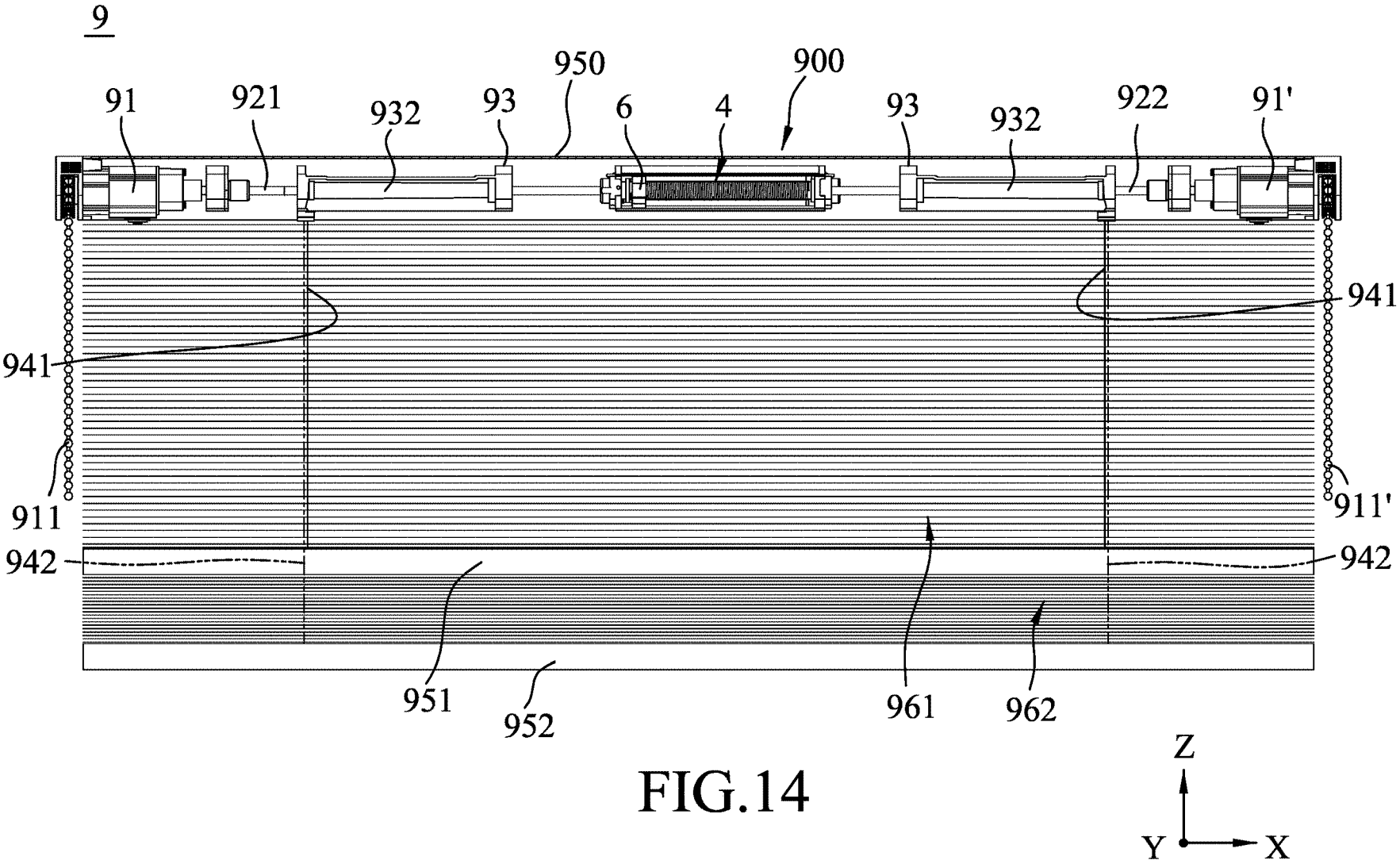
FIG. 14 is a front view of a window blind apparatus in a first shading position, which is partially cross sectioned, and which includes the controller assembly.
Figure 15:
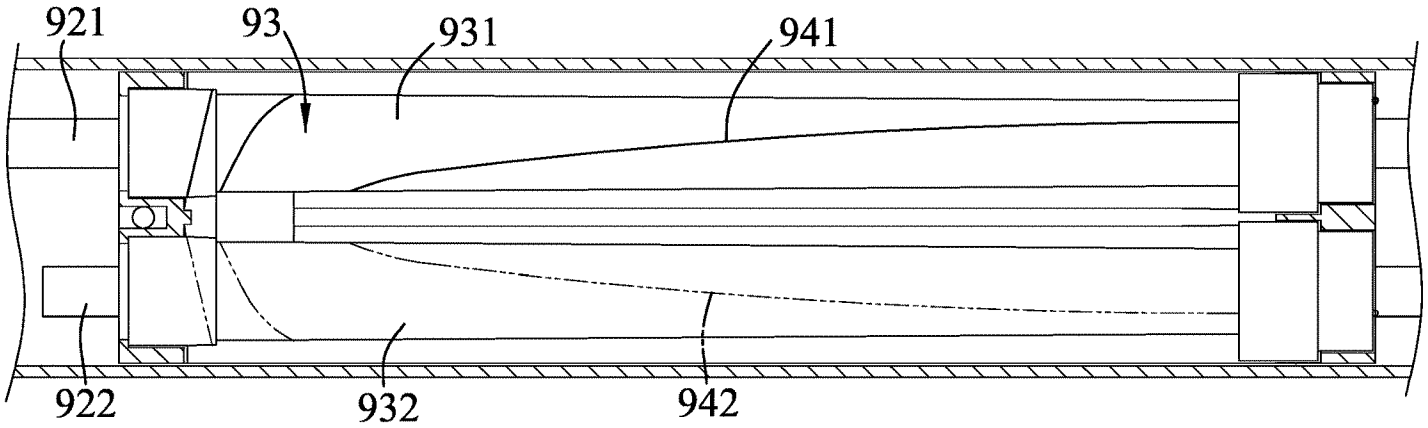
FIG. 15 is a fragmentary, top, partially cross-sectional view illustrating a spool unit when the window blind apparatus is in the first shading position.

In the first shading position, as shown in FIGS. 14 to 16, the first cellular shade 961 has a relatively large covering area, the first lift cords 941 are almost unwound from the first tubular spools 931 of the spool units 93, respectively, and the second lift cords 942 are almost unwound from the second tubular spools 932 of the spool units 93, respectively. Furthermore, as shown in FIGS. 12 and 16, the first runner 5 is the first left end position, and the second runner 6 is in the second left end position. Because the leftward and rightward abutment surfaces 52, 62 of the first and second runners 5, 6 are in abutment with each other, rotation of the first tube unit 3 in an unwinding direction (D2) is impeded, thereby preventing rotation of the first tubular spools 931 for further unwinding lift of the first cords 941. Similarly, rotation of the second tube unit 4 in the unwinding direction (D2) is also impeded, thereby preventing rotation of the second tubular spools 932 for further unwinding of the second lift cords 942.

In the first shading position, if the first tube unit 3 is driven to rotate in the unwinding direction (D2), the first tube unit 3 may move rightward against the biasing force of the first biasing spring 7 to bring the first locked peg 36 into locking engagement with the first locking pin 206 (see FIGS. 12 and 16) so as to further impede rotation of the first tube unit 3. Else, in the first shading position, if the first tube unit 3 is driven to rotate in a winding direction (D1), the first tube unit 3 is biased by the first biasing spring 7 to permit disengagement of the first locked peg 36 from the first locking pin 206, thereby allowing rotation of the first tube unit 3 (i.e., allowing rotation of the first tubular spools 931 for winding of the first lift cords 941).

In the first shading position, if the second tube unit 4 is driven to rotate in the unwinding direction (D2), the rightward locked peg 47 may be brought into locking engagement with the leftward locking pin 63 (see FIG. 16) so as to further impede rotation of the second tube unit 4.

To transform the window blind apparatus 9 from the first shading position (FIGS. 14 to 16) to the second shading position (FIGS. 17 to 19), the first actuating cord 911 is actuated to permit the first drive shaft 921 to be driven by the first force output member 91, thereby allowing the first tubular spools 931 and the first tube unit 3 to rotate in the winding direction (D1) (see FIGS. 10 and 11) so that the first lift cords 941 are respectively wound on the first tubular spools 931 to lift the middlerail 951. When the middlerail 951 is lifted to a first uppermost position (FIG. 17), the window blind apparatus 9 is transformed to the second shading position. In the second shading position, the second cellular shade 962 has a relatively large covering area, the first runner 5 is the first right end position, and the second runner 6 is in the second left end position.

To transform the window blind apparatus 9 from the second shading position (FIGS. 17 to 19) to the fully collapsed position (FIGS. 20 to 22), the second actuating cord 911' is actuated to permit the second drive shaft 922 is driven by the second force output member 91', thereby allowing the second tubular spools 932 and the second tube unit 4 to rotate in the winding direction (D1) (see FIGS. 10 and 11) so that the second lift cords 942 are respectively wound on the second tubular spools 932 to lift the bottomrail 952. When the bottomrail 952 is lifted to a second uppermost position, the window blind apparatus 9 is transformed to the fully collapsed position. In the fully collapsed position, both the first and second cellular shades 961, 962 are collapsed, the first runner 5 is the first right end position, and the second runner 6 is in the second right end position.

In the fully collapsed position, if the first tube unit 3 is driven to rotate in the unwinding direction (D2), the first tube unit 3 may move rightward against the biasing force of the first biasing spring 7 to bring the first locked peg 36 into locking engagement with the first locking pin 206 (the first tube unit 3 is in a situation similar to FIG. 16 or 25) so as to further impede rotation of the first tube unit 3 (and impede rotation of the first tubular spools 931), thereby preventing unwinding of the first lift cords 941. Therefore, the middlerail 951 may be prevented from moving downwardly over the bottomrail 952.

In the fully collapsed position, if the second tube unit 4 is further driven to rotate in the winding direction (D1), the second tube unit 4 may move leftward against the biasing force of the second biasing spring 8 to bring the second locked peg 46 into locking engagement with the second locking pin 207 (the second tube unit 4 is in a situation similar to FIG. 26) so as to further impede rotation of the second tube unit 4 (and impede rotation of the second tubular spools 932), thereby preventing winding of the second lift cords 941. Therefore, the bottomrail 952 may be prevented from moving upwardly over the middlerail 951. Else, in the fully collapsed position, if the second tube unit 4 is driven to rotate in the unwinding direction (D2), the second tube unit 4 is biased by the second biasing spring 8 to permit disengagement of the second locked peg 46 from the second locking pin 207, thereby allowing rotation of the second tube unit 4 and rotation of the second tubular spools 932 for unwinding of the second lift cords 942.

To transform the window blind apparatus 9 from the fully collapsed position (FIGS. 20 to 22) to a partially collapsed position (FIGS. 23 to 26), the first drive shaft 921 is driven by the first force output member 91 to permit the first tubular spools 931 and the first tube unit 3 to rotate in the unwinding direction (D2), while the second drive shaft 922 is driven by the second force output member 91' to permit the second tubular spools 932 and the second tube unit 4 to rotate in the unwinding direction (D2) so that a portion of each of the first lift cords 941 is unwound from a respective one of the first tubular spools 931 to move the middlerail 951 downwardly, and a portion of each of the second lift cords 942 is unwound from the second tubular spools 932 to move the bottomrail 952 downwardly. In the partially collapsed position, the first runner 5 is in a position between the first left and right end positions, and the second runner 6 is in a position between the second left and right end positions.

In the partially collapsed position, if the first tube unit 3 is further driven to rotate in the unwinding direction (D2), the first tube unit 3 may move rightward against the biasing force of the first biasing spring 7 to bring the first locked peg 36 into locking engagement with the first locking pin 206 (see FIG. 25) so as to further impede rotation of the first tube unit 3 and rotation of the first tubular spools 931 for further unwinding of the first lift cords 941. Therefore, the middlerail 951 may be prevented from moving downwardly over the bottomrail 952.

In the partially collapsed position, if the second tube unit 4 is further driven to rotate in the winding direction (D1), the second tube unit 4 may move leftward against the biasing force of the second biasing spring 8 to bring the second locked peg 46 into locking engagement with the second locking pin 207 (see FIG. 26) so as to further impede rotation of the second tube unit 4 and rotation of the second tubular spools 932 for further winding of the second lift cords 942. Therefore, the bottomrail 952 may be prevented from moving upwardly over the middlerail 951.

In addition, because the second lift cords 942 may not be wound on the second tubular spools 932 to lift the bottomrail 162 if the middlerail 161 is not sufficiently lifted, the second lift cords 942 may be prevented from undue stretching.

In sum, with the provision of the controller assembly 900 in the window blind apparatus 9, the middlerail 951 is less likely to move downwardly over the bottomrail 952, and the bottomrail 952 is less likely to move upwardly over the middlerail 951. Therefore, loosening or tangling of the first and second lift cords 941, 942 may be prevented.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A controller assembly for a first drive shaft and a second drive shaft, said controller assembly comprising:

a housing including a left wall and a right wall which is spaced apart from said left wall in a left-right direction, each of said left and right walls having a first through bore and a second through bore;

a first tube unit having a first outer threaded surface, and rotatably retained in said housing, said first tube unit being coupled to be driven by the first drive shaft to rotate about a first axis which extends in the left-right direction, said first tube unit including a first left tubular stem configured to be rotatably received in said first through bore of said left wall, a first right tubular stem configured to be rotatably received in said first through bore of said right wall, a first screw tube disposed between said first left and right tubular stems, and having said first outer threaded surface, a first left outer flange provided between said first left tubular stem and said first screw tube to prevent insertion of said first screw tube into said first through bore of said left wall, and a first right outer flange provided between said first right tubular stem and said first screw tube to prevent insertion of said first screw tube into said first through bore of said right wall;

a second tube unit having a second outer threaded surface, and rotatably retained in said housing, said second tube unit being spaced apart from said first tube unit in a front-rear direction, and being coupled to be driven by the second drive shaft to rotate about a second axis which extends in the left-right direction, said second tube unit including a second left tubular stem configured to be rotatably received in said second through bore of said left wall, a second right tubular stem configured to be rotatably received in said second through bore of said right wall, a second screw tube disposed between said second left and right tubular stems, and having said second outer threaded surface, a second left outer flange provided between said second left tubular stem and said second screw tube to prevent insertion of said second screw tube into said second through bore of said left wall, and a second right outer flange provided between said second right tubular stem and said second screw tube to prevent insertion of said second screw tube into said second through bore of said right wall;

a first runner having a first inner threaded bore which is configured to be in threaded engagement with said first outer threaded surface of said first tube unit, said first runner being retained to slide along the first axis when said first tube unit is driven to rotate about the first axis;

a second runner having a second inner threaded bore which is configured to be in threaded engagement with said second outer threaded surface of said second tube unit, said second runner being retained to slide along the second axis when said second tube unit is driven to rotate about the second axis, said first and second runners being configured to be brought into abutment with each other in the left-right direction, such that in response to leftward sliding of said first runner to bring said first runner into abutment with said second runner, said first runner is prevented from sliding leftward over said second runner, whilst impeding rotation of said first tube unit, and such that in response to rightward sliding of said second runner to bring said second runner into abutment with said first runner, said second runner is prevented from sliding rightward over said first runner, whilst impeding rotation of said second tube unit;

a first biasing spring disposed in said first through bore of said right wall to bias said first right outer flange away from said right wall; and a second biasing spring disposed in said second through bore of said left wall to bias said second left outer flange away from said left wall, wherein said first runner is formed with a first stop tab which has a leftward abutment surface, and said second runner is formed with a second stop tab which has a rightward abutment surface, said leftward and rightward abutment surfaces being configured to be brought into abutment with each other in the left-right direction when said first and second runners are in abutment with each other;

wherein said first tube unit further includes a first locked peg provided on a right surface of said first right outer flange, and a first locking pin is provided inside said housing on said right wall, such that when said leftward abutment surface is spaced apart from said rightward abutment surface in the left-right direction, said first locked peg is biased by said first biasing spring to be disengaged from said first locking pin, thereby permitting said first tube unit to rotate relative to said housing, and such that once said first runner is moved to bring said leftward abutment surface into abutment with said rightward abutment surface, said first tube unit is permitted to move rightward against a biasing force of said first biasing spring to bring said first locked peg into locking engagement with said first locking pin so as to further impede rotation of said first tube unit; and wherein said second tube unit further includes a second locked peg provided on a left surface of said second left outer flange, and a second locking pin is provided inside said housing on said left wall, such that when said leftward abutment surface is spaced apart from said rightward abutment surface in the left-right direction, said second locked peg is biased by said second biasing spring to be disengaged from said second locking pin, thereby permitting said second tube unit to rotate relative to said housing, and such that once said second runner is moved to bring said rightward abutment surface into abutment with said leftward abutment surface, said second tube unit is permitted to move leftward against a biasing force of said second biasing spring to bring said second locked peg into locking engagement with said second locking pin so as to further impede rotation of said second tube unit.

2. The controller assembly according to claim 1, wherein a left end of said second runner is formed with a leftward locking pin, and said second tube unit further includes a rightward locked peg provided on a right surface of said second left outer flange such that once said second runner is moved to the second left position, said rightward locked peg is permitted to be brought into locking engagement with said leftward locking pin so as to impede rotation of said second tube unit.

3. The controller assembly according to claim 1, wherein, when said first tube unit is driven to rotate, said first runner is retained by said housing to slide between a first left end position and a first right end position;

wherein, when said second tube unit is driven to rotate, said second runner is retained by said housing to slide between a second left end position and a second right end position;

wherein, when said first runner is in the first left position, said second runner is kept in the second left position with said rightward abutment surface in abutment with said leftward abutment surface; and wherein, when said second runner is in the second right position, said first runner is kept in the first right position with said leftward abutment surface in abutment with said rightward abutment surface.

4. The controller assembly according to claim 3, wherein said housing further includes an upper wall, a lower wall which is spaced apart from said upper wall in an upright direction, each of said upper and lower walls having a first wall segment and a second wall segment opposite to said first wall segment in the front-rear direction, each of said left and right walls having a third wall segment which is formed with said first through hole, and a fourth wall segment which is opposite to said third wall segment in the front-rear direction and which is formed with said second through hole;

wherein said first tube unit is configured to be rotatably retained between said third wall segments of said left and right walls, and said second tube unit is configured to be rotatably retained between said fourth wall segments of said left and right walls; and wherein said first runner is configured to be slidably and fittingly retained between said first wall segments of said upper and lower walls, and said second runner is configured to be slidably and fittingly retained between said second wall segments of said upper and lower walls.

* * * * *